US007000715B2

(12) United States Patent
Sinor et al.

(10) Patent No.: US 7,000,715 B2
(45) Date of Patent: Feb. 21, 2006

(54) ROTARY DRILL BITS EXHIBITING CUTTING ELEMENT PLACEMENT FOR OPTIMIZING BIT TORQUE AND CUTTER LIFE

(75) Inventors: Lawrence Allen Sinor, Kingwood, TX (US); Christopher C. Beuershausen, Spring, TX (US); Mark W. Dykstra, Kingwood, TX (US); Roger Fincher, Conroe, TX (US); Roland Illerhaus, The Woodlands, TX (US); Rudolf C. O. Pessier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 151 days.

(21) Appl. No.: 10/233,329

(22) Filed: Aug. 30, 2002

(65) Prior Publication Data

US 2003/0037964 A1 Feb. 27, 2003

Related U.S. Application Data

(63) Continuation-in-part of application No. 09/854,765, filed on May 14, 2001, now Pat. No. 6,443,249, which is a continuation of application No. 08/925,525, filed on Sep. 8, 1997, now Pat. No. 6,230,828.

(51) Int. Cl.
*E21B 10/46* (2006.01)

(52) U.S. Cl. ..... 175/431; 175/428

(58) Field of Classification Search ..... 175/426, 175/428, 430–433, 398–400, 374, 378
See application file for complete search history.

(56) References Cited

U.S. PATENT DOCUMENTS

| | | | |
|---|---|---|---|
| 4,109,737 | A | 8/1978 | Bovenkerk |
| 4,342,368 | A | 8/1982 | Denman |
| RE32,036 | E | 11/1985 | Dennis |

(Continued)

FOREIGN PATENT DOCUMENTS

| | | |
|---|---|---|
| GB | 2 318 140 A | 4/1998 |
| GB | 2 323 398 A | 9/1998 |
| WO | WO 97/30263 | 8/1997 |

OTHER PUBLICATIONS

Search Report under Section 17, Application No. GB 9802375.7, Jul. 15, 1998, 1 page.

*Primary Examiner*—Sunil Singh
(74) *Attorney, Agent, or Firm*—TraskBritt, PC

(57) ABSTRACT

A superabrasive cutter-equipped rotary drag bit especially suitable for directional drilling in subterranean formations is provided. The bit may employ PDC cutters in an engineered cutter placement profile exhibiting optimal aggressiveness in relation to where the cutters are positioned along the profile of the bit extending from a cone region laterally, or radially, outward toward a gage region therefore. The engineered cutter placement profile may include cutters exhibiting differing degrees of aggressiveness positioned in order to maximize rate-of-penetration and minimize torque-on-bit while maintaining side cutting capability and steerability.

99 Claims, 14 Drawing Sheets

U.S. PATENT DOCUMENTS 4,558,753 A 12/1985 Barr
4,570,726 A 2/1986 Hall
4,592,433 A 6/1986 Dennis
4,593,777 A 6/1986 Barr
4,607,711 A 8/1986 Zijsling
4,660,659 A 4/1987 Short, Jr. et al.
4,673,044 A 6/1987 Bigelow et al.
4,679,639 A 7/1987 Barr et al.
4,792,001 A 12/1988 Zijsling
4,808,044 A 2/1989 Tsujimura et al.
4,926,950 A 5/1990 Zijsling
4,932,484 A 6/1990 Warren et al.
4,987,800 A 1/1991 Gasan et al.
5,016,718 A 5/1991 Tandberg
5,025,874 A 6/1991 Barr et al.
5,078,219 A 1/1992 Morrell et al.
5,101,691 A 4/1992 Barr
5,120,327 A 6/1992 Dennis
5,314,033 A * 5/1994 Tibbitts ..... 175/431
5,351,772 A 10/1994 Smith
5,377,773 A 1/1995 Tibbitts
5,435,403 A 7/1995 Tibbitts
5,437,343 A 8/1995 Cooley et al.
5,443,565 A 8/1995 Strange, Jr.
5,460,233 A 10/1995 Meany et al.
5,467,836 A 11/1995 Grimes et al.
5,549,171 A 8/1996 Mensa-Wilmot et al.
5,605,198 A 2/1997 Tibbitts et al.
5,655,612 A 8/1997 Grimes et al.
5,706,906 A 1/1998 Jurewicz et al.
5,722,499 A 3/1998 Nguyen et al.
5,743,346 A 4/1998 Flood et al.
5,787,022 A 7/1998 Tibbitts et al.
5,873,422 A * 2/1999 Hansen et al. ..... 175/399
5,924,501 A 7/1999 Tibbitts
5,937,958 A 8/1999 Mensa-Wilmot et al.
5,950,747 A 9/1999 Tibbitts et al.
5,960,896 A 10/1999 Barr et al.
6,000,483 A 12/1999 Jurewicz et al.
6,003,623 A 12/1999 Miess
6,021,859 A 2/2000 Tibbitts et al.
6,065,554 A 5/2000 Taylor et al.
6,164,394 A * 12/2000 Mensa-Wilmot et al. ... 175/331

* cited by examiner

ROTARY DRILL BITS EXHIBITING CUTTING ELEMENT PLACEMENT FOR OPTIMIZING BIT TORQUE AND CUTTER LIFE

CROSS-REFERENCE TO RELATED APPLICATIONS

This application is a continuation-in-part of U.S. patent application Ser. No. 09/854,765 filed May 14, 2001, now U.S. Pat. No. 6,443,249, issued Sep. 3, 2002, which is a continuation of Ser. No. 08/925,525, filed Sep. 8, 1997, now U.S. Pat. No. 6,230,828, issued May 15, 2001, the disclosures of each of which are incorporated herein by reference.

BACKGROUND OF THE INVENTION

1. Field of the Invention

The present invention relates generally to rotary bits for drilling subterranean formations. More specifically, the invention relates to fixed cutter, or so-called "drag" bits particularly suitable for directional drilling.

2. State of the Art

In state-of-the-art directional drilling of subterranean formations, also sometimes termed steerable or navigational drilling, a single bit disposed on a drill string, usually connected to the drive shaft of a downhole motor of the positive-displacement (Moineau) type, is employed to drill both linear and nonlinear borehole segments without tripping of the string from the borehole. Use of a deflection device such as a bent housing, bent sub, eccentric stabilizer, or combinations of the foregoing in a bottomhole assembly (BHA) including a motor, permit a fixed rotational orientation of the bit axis at an angle to the drill string axis for nonlinear drilling when the bit is rotated solely by the motor drive shaft. When the drill string is rotated in combination with rotation of the motor shaft, the superimposed rotational motions cause the bit to drill substantially linearly. Other directional methodologies employing non-rotating BHAs using lateral thrust pads or other members immediately above the bit also permit directional drilling using drill string rotation alone.

In either case, for directional drilling of nonlinear borehole segments, the face aggressiveness (aggressiveness of the cutters disposed on the bit face) is a critical feature, since it is largely determinative of how a given bit responds to sudden variations in bit load. Unlike roller cone bits, rotary drag bits employing fixed superabrasive cutters (usually comprising polycrystalline diamond compacts, or "PDCs") are very sensitive to load, which sensitivity is reflected in much steeper rate of penetration (ROP) versus weight on bit (WOB) and torque on bit (TOB) versus WOB curves, as illustrated in FIGS. 1 and 2 of the drawings. Such high WOB sensitivity causes problems in directional drilling, wherein the borehole geometry is irregular and results in "sticktion" of the BHA, while drilling a nonlinear path renders a smooth, gradual transfer of weight to the bit with extreme difficulty. These conditions frequently cause motor stalling, and loss or swing of tool face orientation. Poor tool face orientation causes borehole quality, as well as directional control, to decline. In order to establish a new tool face reference point before drilling is recommenced, the driller must stop drilling ahead and pull the bit off the bottom of the borehole, with a resulting loss of time and thus ROP. Conventional methods to reduce rotary drag bit face aggressiveness include greater cutter densities, more blades, higher (negative) cutter backrakes, and the addition of depth of cut limiters to the bit face.

Of the bits referenced in FIGS. 1 and 2 of the drawings, RC comprises a conventional roller cone bit for reference purposes, while FC1 is a conventional polycrystalline diamond compact (PDC) cutter-equipped rotary drag bit having cutters backraked at 20°, while FC2 is the directional version of the same bit with 30° backraked cutters. As can be seen from FIG. 2, the TOB at a given WOB for FC2, which corresponds to its face aggressiveness, may be as much as 30% less as for FC1. Therefore, FC2 is less affected by the sudden load variations inherent in directional drilling. However, referencing FIG. 1, it can also be seen that the less aggressive FC2 bit exhibits a markedly reduced ROP for a given WOB.

Thus, it may be desirable for a bit to demonstrate the less aggressive characteristics of a conventional directional bit such as FC2 for nonlinear drilling without sacrificing ROP to the same degree when WOB is increased to drill a linear borehole segment.

For some time, it has been known that forming a noticeable, annular chamfer on the cutting edge of the diamond table of a PDC cutter enhances the durability of the diamond table, reducing its tendency to spall and fracture during the initial stages of a drilling operation before a wear flat has formed on the side of the diamond table and supporting substrate contacting the formation being drilled.

U.S. Pat. Re 32,036 to Dennis discloses such a chamfered cutting edge, disc-shaped PDC cutter comprising a polycrystalline diamond table formed under high pressure and high temperature conditions onto a supporting substrate of tungsten carbide. For conventional PDC cutters, a typical chamfer size and angle would be 0.010 inch (measured radially and looking at and perpendicular to the cutting face) oriented at a 45° angle with respect to the longitudinal cutter axis, thus providing a larger radial width as measured on the chamfer surface itself. Multi-chamfered PDC cutters are also known in the art, as taught by U.S. Pat. No. 5,437,343 to Cooley et al., assigned to the assignee of the present invention. Rounded, rather than chamfered, cutting edges are also known, as disclosed in U.S. Pat. No. 5,016,718 to Tandberg.

For a period of time, the diamond tables of PDC cutters were limited in depth or thickness to about 0.030 inch or less, due to the difficulty in fabricating thicker tables of adequate quality. However, recent process improvements have provided much thicker diamond tables, in excess of 0.070 inch, up to and including 0.150 inch. U.S. Pat. No. 5,706,906 to Jurewicz et al., assigned to the assignee of the present invention, and hereby incorporated herein by this reference, discloses and claims several configurations of a PDC cutter employing a relatively thick diamond table. Such cutters include a cutting face bearing a large chamfer or "rake land" thereon adjacent the cutting edge, which rake land may exceed 0.050 inch in width, measured radially and across the surface of the rake land itself. Other cutters employing a relatively large chamfer without such a great depth of diamond table are also known.

Recent laboratory testing as well as field tests have conclusively demonstrated that one significant parameter affecting PDC cutter durability is the cutting edge geometry. Specifically, larger leading chamfers (the first chamfer on a cutter to encounter the formation when the bit is rotated in the usual direction) provide more durable cutters. The robust character of the above-referenced "rake land" cutters corroborates these findings. However, it was also noticed that cutters exhibiting large chamfers may also slow the overall performance of a bit so equipped, in terms of ROP. Such low ROP characteristics of large chamfer cutters were thus perceived as a detriment.

BRIEF SUMMARY OF THE INVENTION

The inventors herein have recognized that varying the effective cutting face backrake angles of the various cutting elements, such as PDC cutters, as a function of, or in relationship to, the engineered placement of the cutters at locations on the bit face may be employed to control the torque response of the bit as it engages a formation. In an embodiment of the present invention, a drill bit, such as a rotary drag bit, is provided with an engineered cutter placement profile wherein at least half of the cutters placed generally within the cone region, or radially innermost portion, of the bit face exhibit a desired aggressiveness, and at least half of the cutters placed generally within the nose region, or radially intermediate portion, of the bit face exhibit a desired aggressiveness. Similarly, at least half of the cutters generally placed along the shoulder and/or flank region, or radially proximate but preferably short of the gage, of the bit face exhibit a desired aggressiveness.

For example, there are at least two conceptual applications, among others, that may utilize the present invention. First, in a steerable application it may be desirable to maintain side cutting ability while making the drill bit less aggressive overall, as discussed above. Second, it may be desirable to provide a low torque, fast-drilling bit wherein the drill bit is configured with relatively low backrake cutters in the center, the backrake increasing toward the outer diameter of the bit to enhance durability. Further, by way of tailoring the aggressiveness as well as considering the radial position of the cutters on the bit, overall torque may be reduced, thereby increasing the efficiency of drilling and reducing cutter temperatures.

In an embodiment of the present invention, directed more toward directional applications, a drill bit, such as a rotary drag bit, is provided with an engineered cutter placement profile wherein at least half of the cutters placed generally within the cone region, or radially inner most portion, of the bit face exhibit a relatively low aggressiveness, and at least half of the cutters placed generally within the nose region, or radially intermediate portion, of the bit face exhibit a relatively more aggressive, or intermediate level of aggressiveness. Whereas, at least half of the cutters generally placed along the shoulder and/or flank region, or radially proximate but preferably short of the gage, of the bit face exhibit a relatively high degree of cutter aggressiveness. Thus, a drill bit incorporating a cutter placement profile in accordance with the present invention affords adequate side cutting capability for nonlinear or directional drilling. Furthermore, the present invention provides an extended bit life afforded by having less aggressive cutters positioned in the cone region which are better able to survive encounters with relative hard formations or hard stringers.

Configuring a drill bit as outlined above positions cutters with the largest radial torque arm having relatively lower backrake angles, and thus reduces the torque on the bit. Furthermore, the present invention, as configured above, provides an extended bit life afforded by having less aggressive cutters positioned in the cone region which are better able to survive encounters with relative hard formations or hard stringers. Furthermore, a bit incorporating an effective cutting face backrake angle profile in accordance with the present invention enables a borehole segment to progress at a greater ROP at a given WOB while generating a lower TOB as compared to conventional directional or steerable bits with highly backraked cutters, or bits having more aggressive cutters inside the cone region and less aggressive cutters toward the gage region as in accordance with the prior art. Such a greater ROP therefore translates into a lower drilling cost per foot in addition to providing a drill bit having a longer life expectancy. Moreover, chamfer width as well as chamfer backrake angle may be tailored to reduce the TOB for a given WOB or ROP.

In one embodiment of the present invention, a rotary drag bit is provided with an engineered cutter placement profile wherein at least half of the cutters placed generally in the cone region of the bit exhibit an effective cutting face backrake angle ranging between approximately negative 45° and negative 10°, at least half of the cutters placed generally in the nose region exhibit an effective cutting face backrake angle ranging between approximately negative 30° and approximately negative 5°, and at least half of cutters placed generally in the shoulder and/or flank of the bit exhibit an effective cutting face backrake angle not exceeding approximately negative 15°.

Another embodiment of the present invention includes a rotary drag bit including a cutter placement profile wherein at least half of the total number of the cutters placed generally in the cone region exhibit an effective cutting face backrake angle of approximately negative 30°, at least half of the total number of cutters placed generally in the nose region exhibit an effective backrake angle of approximately negative 20°, and at least half of the total number of cutters placed generally in the shoulder and/or flank of the bit exhibit an effective cutting face backrake angle of approximately negative 10°. Such a configuration provides a cutter placement profile in accordance with the present invention suitable for a wide-variety of drilling applications while maximizing bit life.

Turning to a durable, yet fast drilling and lower torque drill bit embodiment of the present invention, a rotary drag bit may include a cutter placement profile which is suitable for a wide variety of drilling applications while also maximizing the life of the bit wherein at least half of the total number of the cutters placed in the cone region exhibit an effective cutting face backrake angle of approximately negative 7°, at least half of the total number of cutters placed in the nose region exhibit an effective cutting face backrake angle of approximately negative 10°, and at least half of the total number of cutters placed proximate the shoulder region of the bit exhibit an effective cutting face backrake angle of approximately negative 15°.

In another embodiment of the present invention, the engineered cutter placements and respective effective cutting face backrake angles are not necessarily based upon particular regions of a bit in which the cutters are placed, but are based, at least in part, upon controlling how the bit will respond to formations of different hardnesses and the associated amount of torque generated by the bit as it engages formations of different hardnesses while maintaining or enhancing the rate-of-penetration of the bit through such formations. Thus, bits embodying the present invention include cutter placement profiles wherein at least a significant number of cutters positioned on the face of the bit exhibit an appropriate degree of aggressiveness, i.e., exhibiting a selected amount of effective cutting face backrake angles based upon the expected load to be placed on each cutter so as to control the amount of torque each such cutter will generate upon each of such cutters actually being loaded. By optimally selecting the amount of aggressiveness each cutter is to have, the ROP of the bit will be maximized while also minimizing the amount of wear and potential damage that each cutter will likely experience. That is, if a given cutter at a given location on the face of a bit is expected to be subjected to a relatively high axial load as it engages a formation, the effective negative backrake angle for such cutter is selected to exhibit an appropriate, or lesser degree of aggressiveness. For example, cutters located in one region of a drag bit are frequently expected to be subject to large amounts of axial load and therefore are provided with a relatively low degree of aggressiveness and cutters located in the shoulder and flank regions of the bit are frequently expected to be subject to small amounts of axial load and larger amounts of tangential loads and may therefore be provided with a high degree of aggressiveness in accordance with the present invention.

An additional aspect of the present invention includes a drill bit, such as a rotary drag bit, having a plurality of cutters disposed over at least a portion of the drill bit intended to engage the formation. This embodiment of the present invention includes disposing cutters having chamfers angled with respect to the longitudinal axis of each cutter and having preselected widths so as to influence the aggressiveness of at least some of the cutters disposed over at least a portion of the face of the bit. Preferably at least some of the cutters in a first region generally radially proximate the longitudinal axis of the bit, such as in the cone of the bit, have chamfers oriented, as measured with respect to the longitudinal axis of each cutter, between approximately 30° to approximately 60° with 45° being particularly suitable for a wide variety of applications. For at least some of the cutters having chamfers in the first region, the width of the chamfers preferably ranges between about 0.030 of an inch and about 0.060 of an inch. For those cutters having chamfers which are positioned on the bit face in a second region generally encompassing the shoulder and/or flank of the bit extending outward toward the gage region of the bit, the chamfers are not as wide, with chamfer widths preferably ranging between about 0.005 of an inch to about 0.020 of an inch to increase the overall aggressiveness of the second region of the bit. The angle of the chamfers of at least some of the cutters in the second region, as measured with respect to the longitudinal axis of the cutters, ranges between approximately 30° and about 60° with approximately 45° being particularly suitable for many applications. Again, for a given application it may be advantageous to tailor chamfers in order to reduce the overall torque response of a drill bit. In general, it may be advantageous to reduce the overall torque for a given application, thus increasing the efficiency of drilling while reducing the temperatures of the cutters during operation.

In a further embodiment, cutters having chamfers in a third region of the bit face exhibit chamfer widths intermediate the chamfer widths of cutters having chamfers in the first and second regions. That is, at least some of the cutters having chamfers which are positioned in a third region of the bit face, such as in the nose of the bit, have chamfer widths that are smaller than the chamfer widths of at least some of the cutters disposed in the first, or cone, region of the bit but have chamfer widths that are larger than the chamfer widths of at least some of the cutters having chamfers that are positioned in the second region of the bit located more radially outward toward the gage of the bit. Providing cutters having intermediately sized chamfer widths provides a level of aggressiveness which is greater than the cone region of the bit but less than the shoulder region of the bit.

Thus, in accordance with the present invention, the aggressiveness of cutters generally positioned in or proximate various regions of the bit face, such as the majority of cutters respectively positioned in the cone, nose, and shoulder regions, are specifically selected and positioned, or oriented, to provide a bit having an appropriate level of aggressiveness along the face of the bit, or stated differently, in at least the exposed regions of the bit body, or face, which actively engage the formation. That is, selecting the effective cutting face backrake angle each cutter is to have within each region of the bit, as well as determining if a given cutter within a given region will have a chamfer, and, if a cutter is to have a chamfer, selecting the chamfer width and chamfer angle each cutter is to have will provide a bit having a cutter aggressiveness profile which will render a greater ROP at a given WOB while generating a lower TOB as compared to conventional bits. Thus, drill bits embodying the present invention appear to outperform conventional bits having highly backraked cutters distributed over generally the entire face of the bit, as well as prior art steerable, or directional, bits having more aggressive cutters positioned in the cone region and less aggressive cutters positioned toward the gage region.

Also encompassed by the present invention are rotary drag bits carrying cutters of differing aggressiveness at different locations along at least a portion of a bit profile extending between proximity to a longitudinal axis of the bit and proximity to a gage of the bit, rather than in distinct or approximate regions of the bit face.

Methods of designing rotary drag bits and of altering a torque response of an existing rotary drag bit are also encompassed by the present invention.

DETAILED DESCRIPTION OF THE INVENTION

As used in the practice of the present invention, and with reference to the size of the chamfers employed in various regions of the exterior of the bit, it should be recognized that the terms "large" and "small" chamfers are relative, not absolute, and that different formations may dictate what constitutes a relatively large or small chamfer on a given bit. Therefore, the following discussion of "small" and "large" chamfers, is merely exemplary and not limiting in order to provide an enabling disclosure and the best mode of practicing the invention as currently understood by the inventors.

Figure 3A:
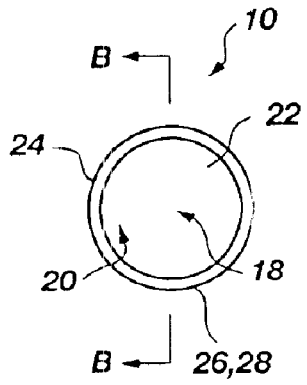
FIG. 3A comprises a frontal view of a small chamfer PDC cutter usable with the present invention and FIG. 3B comprises a side sectional view of the small chamfer PDC cutter of FIG. 3A, taken along section lines B—B.
Figure 3B:
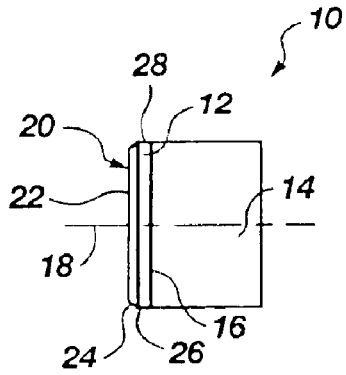

FIGS. 3A and 3B depict an exemplary "small chamfer" cutter 10 comprised of a superabrasive PDC table 12 supported by a tungsten carbide (WC) substrate 14, as known in the art. The interface 16 between the PDC table 12 and the substrate 14 may be planar or non-planar, according to many varying designs for same as known in the art. Cutter 10 is substantially cylindrical, and symmetrical about longitudinal axis 18, although such symmetry is not required and non-symmetrical cutters are known in the art. Cutting face 20 of cutter 10, to be oriented on a bit facing generally in the direction of intended bit rotation, extends substantially transversely to such direction, and to axis 18. The surface 22 of the central portion of cutting face 20 is planar as shown, although concave, convex, ridged or other substantially, but not exactly, planar surfaces may be employed. A chamfer 24 extends from the periphery of surface 22 to cutting edge 26 at the sidewall 28 of PDC table 12. Chamfer 24 and cutting edge 26 may extend about the entire periphery of table 12, or only along a periphery portion to be located adjacent the formation to be cut. Chamfer 24 may comprise the aforementioned 0.010 inch by 45° conventional chamfer, or the chamfer may lie at some other angle, as referenced with respect to the chamfer 124 of cutter 110 described below. While 0.010 inch chamfer size is referenced as an example (within conventional tolerances), chamfer sizes within a range of 0.005 to about 0.020 inch are contemplated as generally providing a "small" chamfer for the practice of the invention. It should also be noted that cutters exhibiting substantially no visible chamfer may be employed for certain applications in selected regions of the bit.

Figure 4:
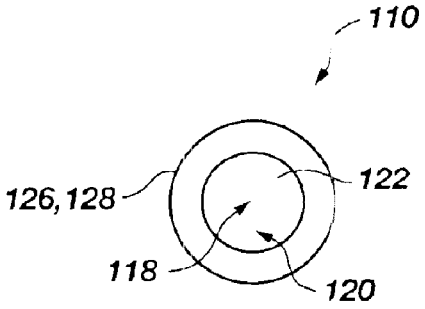
FIG. 4 comprises a frontal view of a large chamfer PDC cutter usable with the present invention.
Figure 5:
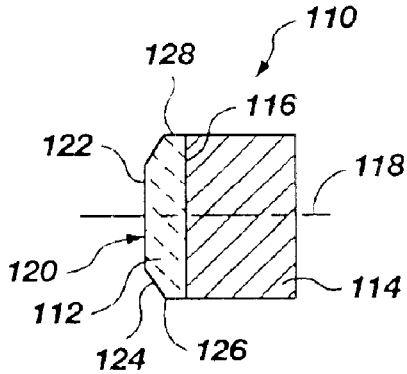
FIG. 5 comprises a side sectional view of a first internal configuration for the large chamfer PDC cutter of FIG. 4.
Figure 6:
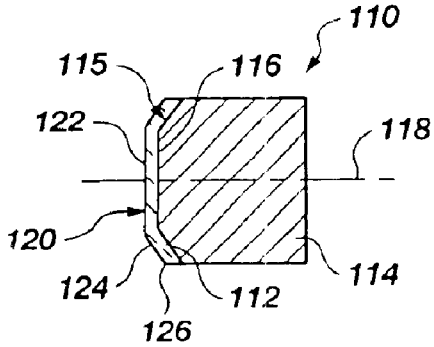
FIG. 6 comprises a side sectional view of a second internal configuration for the large chamfer PDC cutter of FIG. 4.
Figure 7:
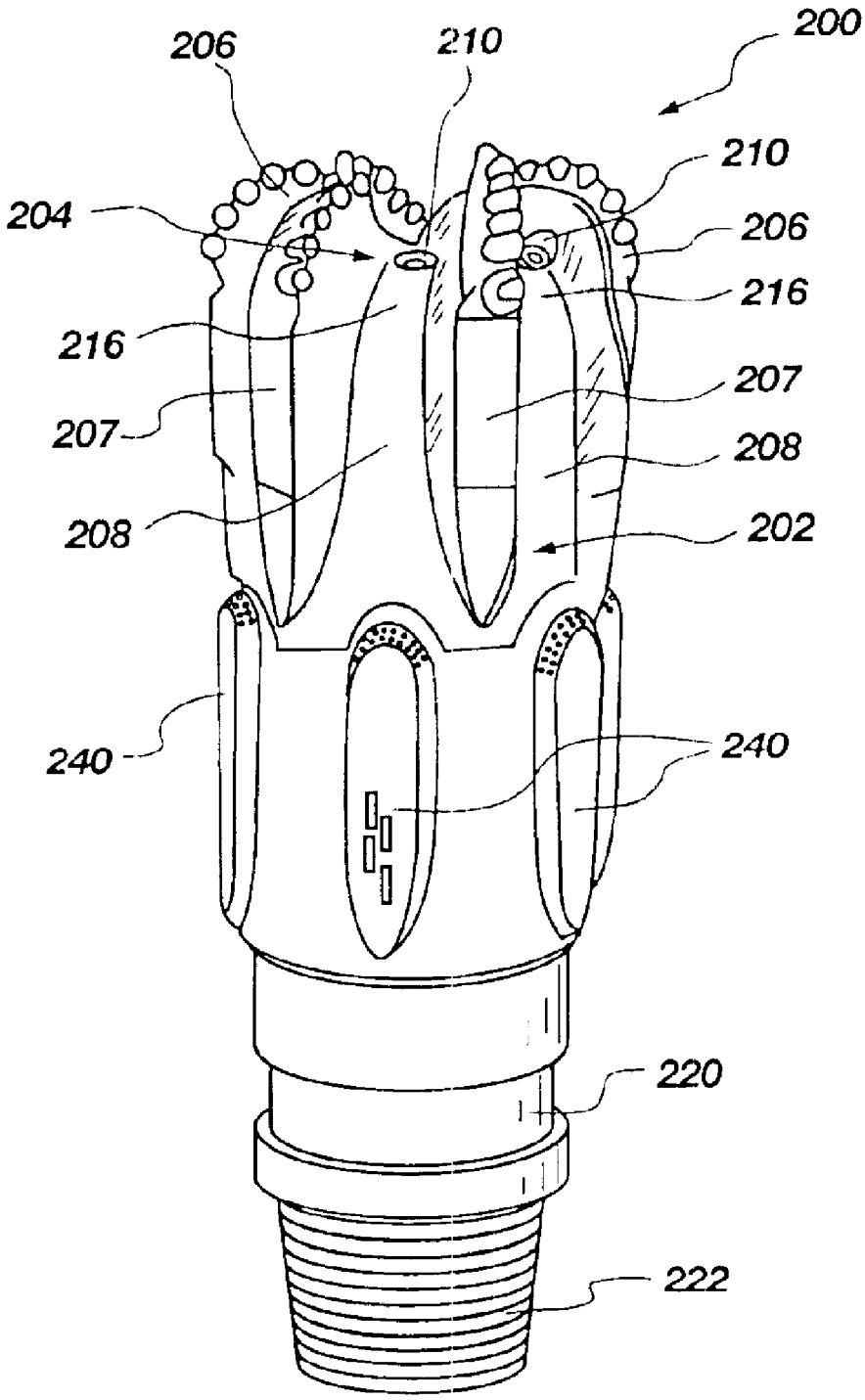
FIG. 7 comprises a side perspective view of a PDC-equipped rotary drag bit according to the present invention.
Figure 8:
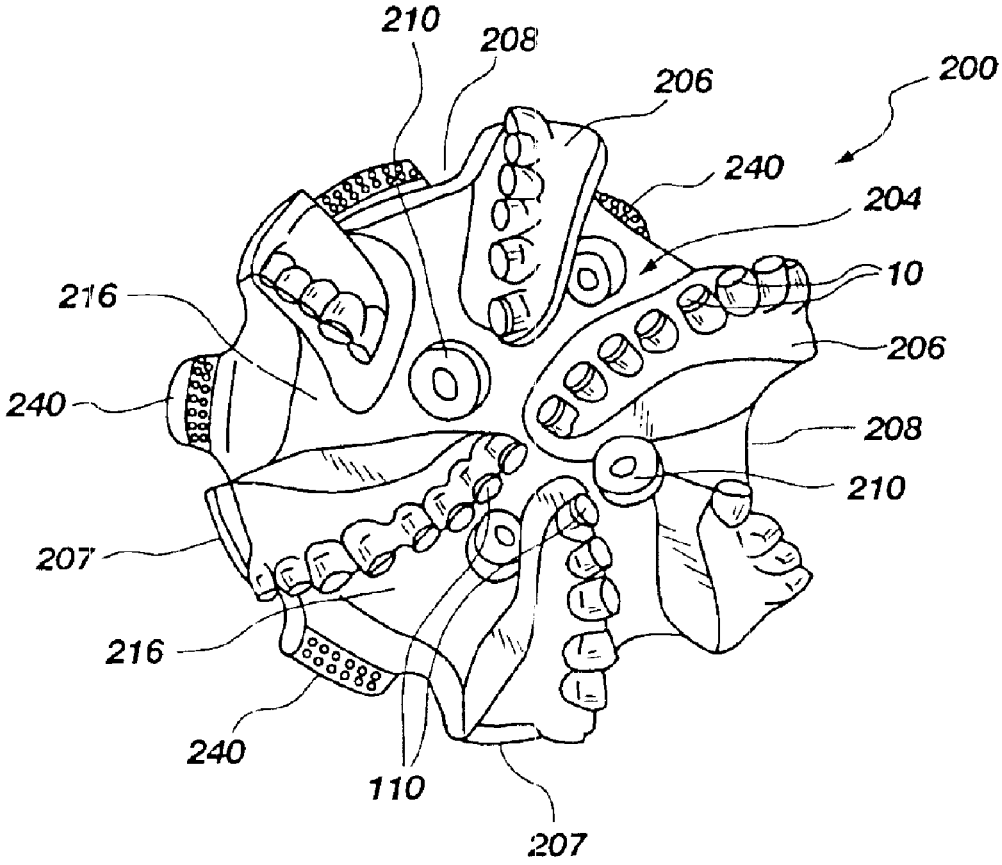
FIG. 8 comprises a face view of the bit of FIG. 7.

FIGS. 4 through 6 depict an exemplary "large chamfer" cutter 110 comprised of a superabrasive PDC table 112 supported by a WC carbide substrate 114. The interface 116 between the PDC diamond table 112 and the substrate 114 may be planar or non-planar, according to many varying designs for same as known in the art (see especially FIGS. 5 and 6). Cutter 110 is substantially cylindrical, and symmetrical about longitudinal axis 118, although such symmetry is not required and non-symmetrical cutters are known in the art. Cutting face 120 of cutter 110, to be oriented on a bit facing generally in the direction of bit rotation, extends substantially transversely to such direction, and to axis 118. The surface 122 of the central portion of cutting face 120 is planar as shown, although concave, convex, ridged or other substantially, but not exactly, planar surfaces may be employed. A chamfer 124 extends from the periphery of surface 122 to cutting edge 126 at the sidewall 128 of PDC table 112. Chamfer 124 and cutting edge 126 may extend about the entire periphery of table 112, or only along a periphery portion to be located adjacent the formation to be cut. Chamfer 124 may comprise a surface oriented at 45° to axis 118, of a width, measured radially and looking at and perpendicular to the cutting face 120, ranging upward in magnitude from about 0.030 inch, and generally lying within a range of about 0.020 to 0.060 inch in width. Chamfer angles of about 10° to about 80° to axis 118 are believed to have utility, with angles in the range of about 30° to about 60° being preferred for most applications. The effective angle of a chamfer relative to the formation face being cut may also be altered by changing the backrake of a cutter.

FIG. 5 illustrates one internal configuration for cutter 110, wherein table 112 is extremely thick, on the order of 0.070 inch or greater, in accordance with the teachings of the aforementioned U.S. Pat. No. 5,706,906.

FIG. 6 illustrates a second internal configuration for cutter 110, wherein the front face 115 of substrate 114 is frusto-conical in configuration, and table 112, of substantially constant depth, substantially conforms to the shape of front face 115 to provide a large chamfer of a desired width without requiring the large PDC diamond mass of the '076 application.

FIGS. 7 through 10 depict a rotary drag bit 200 according to the invention. Bit 200 includes a body 202 having a face 204 and including a plurality (in this instance, six) of generally radially oriented blades 206 extending above the bit face 204 to a gage 207. Junk slots 208 lie between adjacent blades 206. A plurality of nozzles 210 provide drilling fluid from plenum 212 within the bit body 202 and received through passages 214 to the bit face 204. Formation cuttings generated during a drilling operation are transported by the drilling fluid across bit face 204 through fluid courses 216 communicating with respective junk slots 208. Secondary gage pads 240 are rotationally and substantially longitudinally offset from blades 206, and provide additional stability for bit 200, when drilling both linear and nonlinear borehole segments. Such added stability reduces the incidence of ledging of the borehole sidewall, and spiraling of the borehole path. Shank 220 includes a threaded pin connection 222 as known in the art, although other connection types may be employed.

Figure 10:
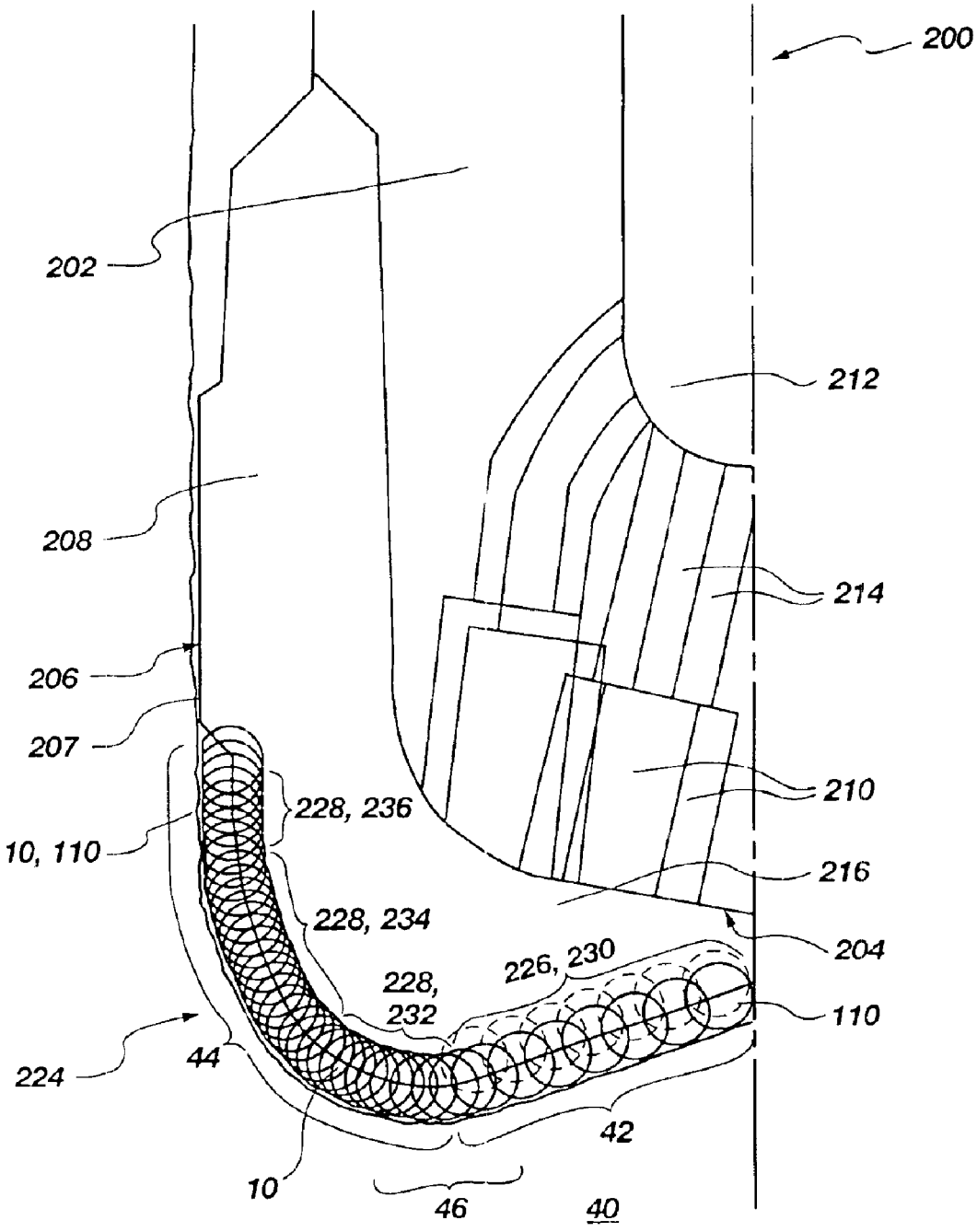
FIG. 10 comprises a quarter-sectional side schematic of a bit having a profile such as that of FIG. 7, with the cutter locations rotated to a single radius extending from the bit centerline to the gage to show the radial bit face locations of the various cutter chamfer sizes and angles, and cutter backrake angles, employed in the bit.

Bit profile 224 of bit face 204 as defined by blades 206 is illustrated in FIG. 10, wherein bit 200 is shown adjacent a subterranean rock formation 40 at the bottom of a well bore. First region 226 and second region 228 on profile 224 face adjacent rock zones 42 and 44 of formation 40 and respectively carry large chamfer cutters 110 and small chamfer cutters 10. First region 226 may be said to comprise the cone 230 of the bit profile 224 as illustrated, whereas second region 228 may be said to comprise nose 232, flank 234, and generally includes shoulder 236 of profile 224, terminating at gage 207.

Figure 9:
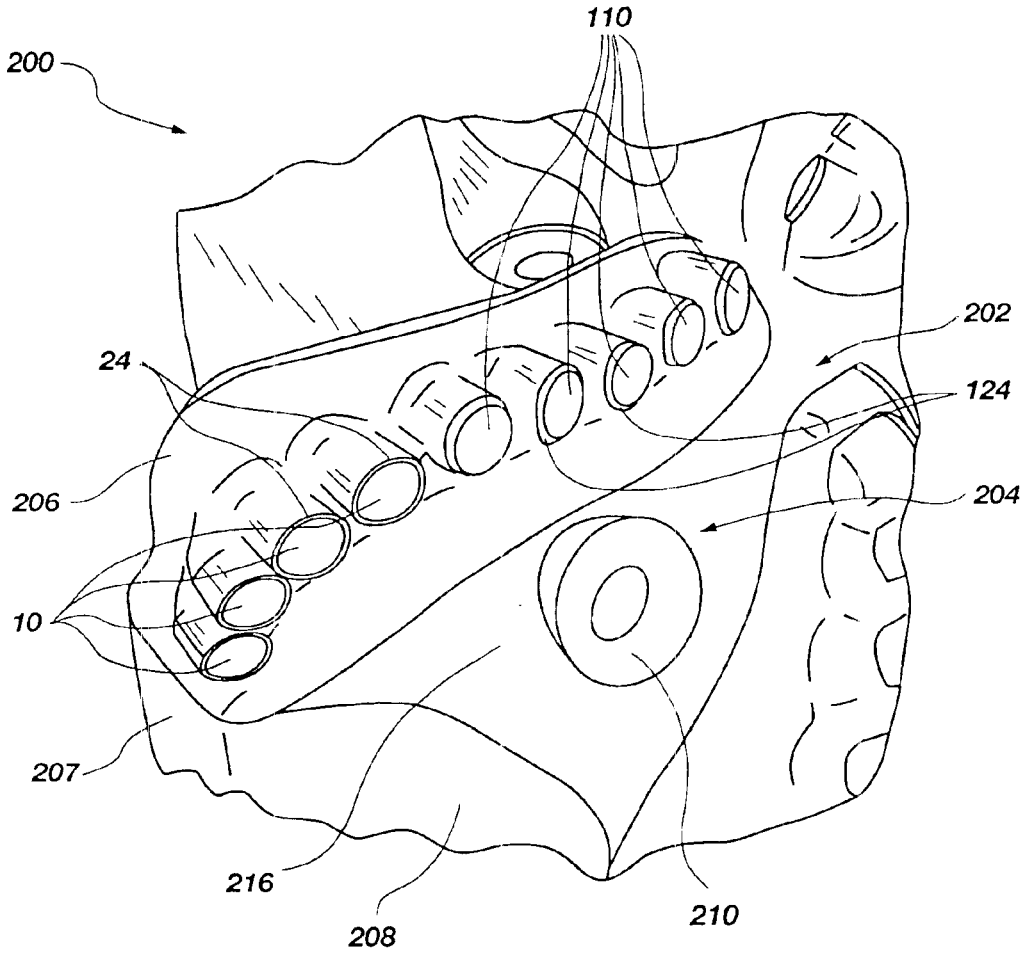
FIG. 9 comprises an enlarged, oblique face view of a single blade of the bit of FIG. 3, illustrating the varying cutter chamfer sizes and angles and cutter rake angles employed.

In a currently preferred embodiment of the invention and with particular reference to FIGS. 9 and 10, large chamfer cutters 110 may comprise cutters having PDC tables in excess of 0.070 inch, and preferably about 0.080 to 0.090 inch depth, with chamfers 124 of about a 0.030 to 0.060 inch width, looking at and perpendicular to the cutting face 120, and oriented at a 45° angle to the longitudinal axis 118. The cutters themselves, as disposed in region 226, are backraked at 20° to the bit profile (see cutters 110 shown partially in broken lines in FIG. 10 to denote 20° backrake) at each respective cutter location, thus providing chamfers 124 with a 65° backrake. Cutters 10, on the other hand, disposed in region 228, may comprise conventionally-chamfered cutters having about a 0.030 inch PDC table thickness, and about a 0.010 to 0.020 inch chamfer width looking at and perpendicular to cutting face 20, with chamfers 24 oriented at a 45° angle to the cutter axis 18. Cutters 10 are themselves backraked at 15° on nose 232 providing a 60° chamfer backrake, while cutter backrake is further reduced to 10° at the flank 234, shoulder 236 and on the gage 207 of bit 200, resulting in a 55° chamfer backrake. The PDC cutters 10 immediately above gage 207 include preformed flats thereon oriented parallel to the longitudinal axis of the bit 200, as known in the art. In steerable applications requiring greater durability at the shoulder 236, large chamfer cutters 110 may optionally be employed, but oriented at a 30° cutter backrake. Further, the chamfer angle of cutters 110 in each of regions 226 and 236 may be other than 45°. For example, 70° chamfer angles may be employed with chamfer widths (looking vertically at the cutting face of the cutter) in the range of about 0.035 to 0.045 inch, cutters 110 being disposed at appropriate backrakes to achieve the desired chamfer rake angles in the respective regions.

A boundary region, rather than a sharp or distinct boundary, may exist between first and second regions 226 and 228. For example, rock zone 46 bridging the adjacent edges of rock zones 24 and 44 of formation 46 may comprise an area wherein demands on cutters and the strength of the formation are always in transition due to bit dynamics. Alternatively, the rock zone 46 may initiate the presence of a third region on the bit profile wherein a third size of cutter chamfer is desirable. In any case, the annular area of profile 224 opposing zone 46 may be populated with cutters of both types (i.e., width and chamfer angle) and employing backrakes respectively employed in region 226 and those of region 228, or cutters with chamfer sizes, angles and cutter backrakes intermediate those of the cutters in regions 226 and 228 may be employed.

Bit 200, equipped as described with a combination of small chamfer cutters 10 and large chamfer cutters 110, will drill with an ROP approaching that of conventional, nondirectional bits equipped only with small chamfer cutters but will maintain superior stability, and will drill far faster than a conventional directional drill bit equipped only with large chamfer cutters.

Figure 1:
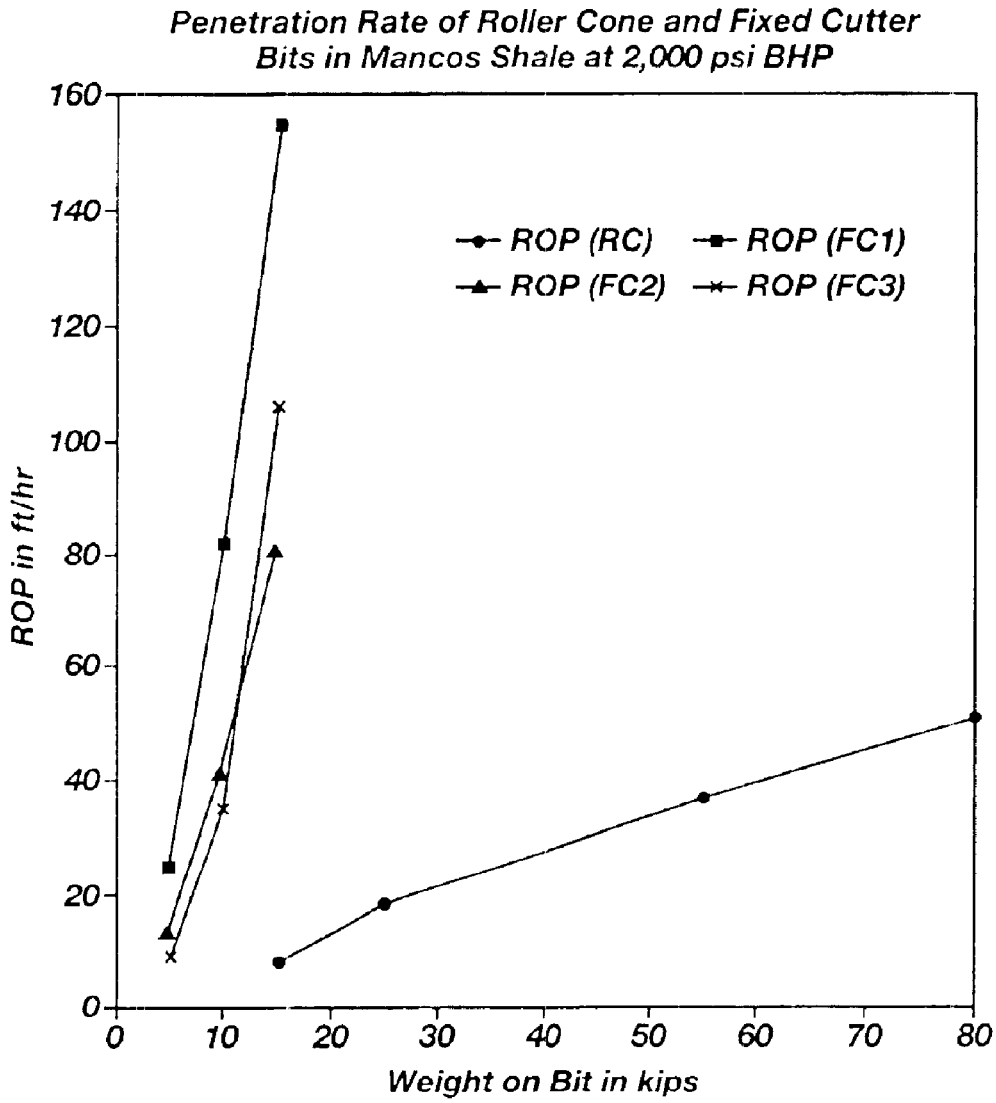
FIG. 1 comprises a graphical representation of ROP versus WOB characteristics of various rotary drill bits in drilling Mancos shale at 2000 psi bottomhole pressure.
Figure 2:
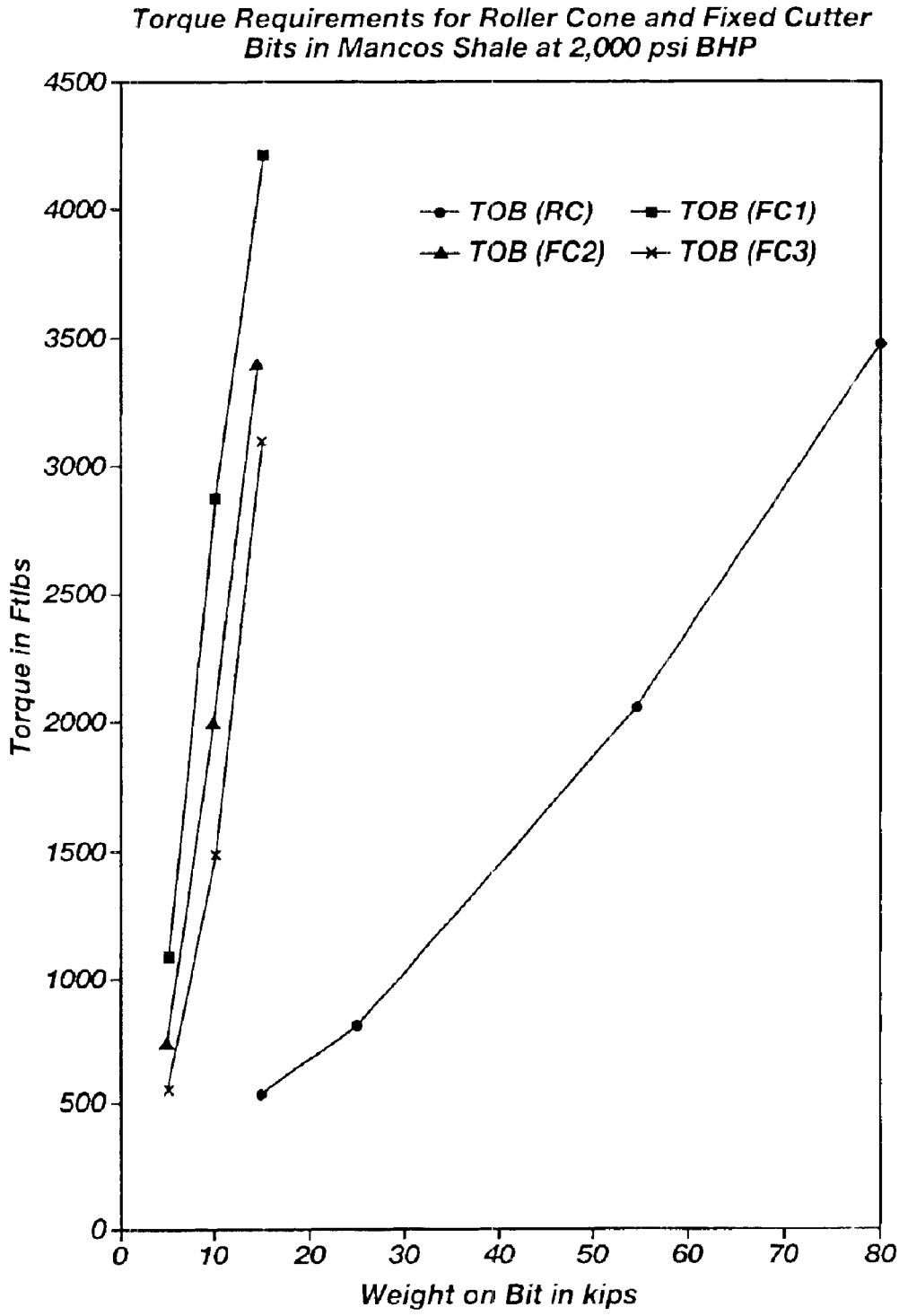
FIG. 2 comprises a graphical representation of TOB versus WOB characteristics of various rotary drill bits in drilling Mancos shale at 2,000 psi bottomhole pressure.

It is believed that the benefits achieved by the present invention result from the aforementioned effects of selective variation of chamfer size, chamfer backrake angle and cutter backrake angle. For example and with specific reference to FIG. 1, the size (width) of the chamfer 124 of the large chamfer cutters 10 at the center of the bit may be selected to maintain nonaggressive characteristics in the bit up to a certain WOB or ROP, denoted in FIGS. 1 and 2 as the "break" in the curve slopes for bit FC3. For equal chamfer backrake angles $\beta 1$, the larger the chamfer 124, the greater WOB must be applied before the bit enters the second, steeper-slope portions of the curves. Thus, for drilling nonlinear borehole segments, wherein applied WOB is generally relatively low, it is believed that a nonaggressive character for the bit may be maintained by drilling to a first depth of cut (DOC1) associated with low WOB wherein the cut is taken substantially within the chamfer 124 of the large chamfer cutters 10 disposed in the center region of the bit. In this instance, the effective backrake angle of the cutting face 120 of cutter 10 is the chamfer backrake $\beta 1$, and the effective included angle $\gamma 1$ between the cutting face 120 and the formation 300 is relatively small. For drilling linear borehole segments, WOB is increased so that the depth of cut (DOC2) extends above the chamfers 124 on the cutting faces 120 of the large chamfer cutters to provide a larger effective included angle $\gamma 2$ (and smaller effective cutting face backrake angle $\beta 2$) between the cutting face 120 and the formation 300, rendering the cutters 110 more aggressive and thus increasing ROP for a given WOB above the break point of the curve of FIG. 1. As shown in FIG. 2, this condition is also demonstrated by a perceptible increase in the slope of the TOB versus WOB curve above a certain WOB level. Of course, if a chamfer 124 is excessively large, excessive WOB may have to be applied to cause the bit to become more aggressive and increase ROP for linear drilling.

The chamfer backrake angle $\beta 1$ of the large chamfer cutters 110 may be employed to control DOC for a given WOB below a threshold WOB wherein DOC exceeds the chamfer depth perpendicular with respect to the formation.

The smaller the included angle γ1 between the chamfer 124 and the formation 300 being cut, the more WOB being required to effect a given DOC. Further, the chamfer rake angle β1 predominantly determines the slopes of the ROP\ WOB and TOB\ WOB curves of FIGS. 1 and 2 at low WOB and below the breaks in the curves, since the cutters 110 apparently engage the formation to a DOC1 residing substantially within the chamfer 124.

Figure 11:
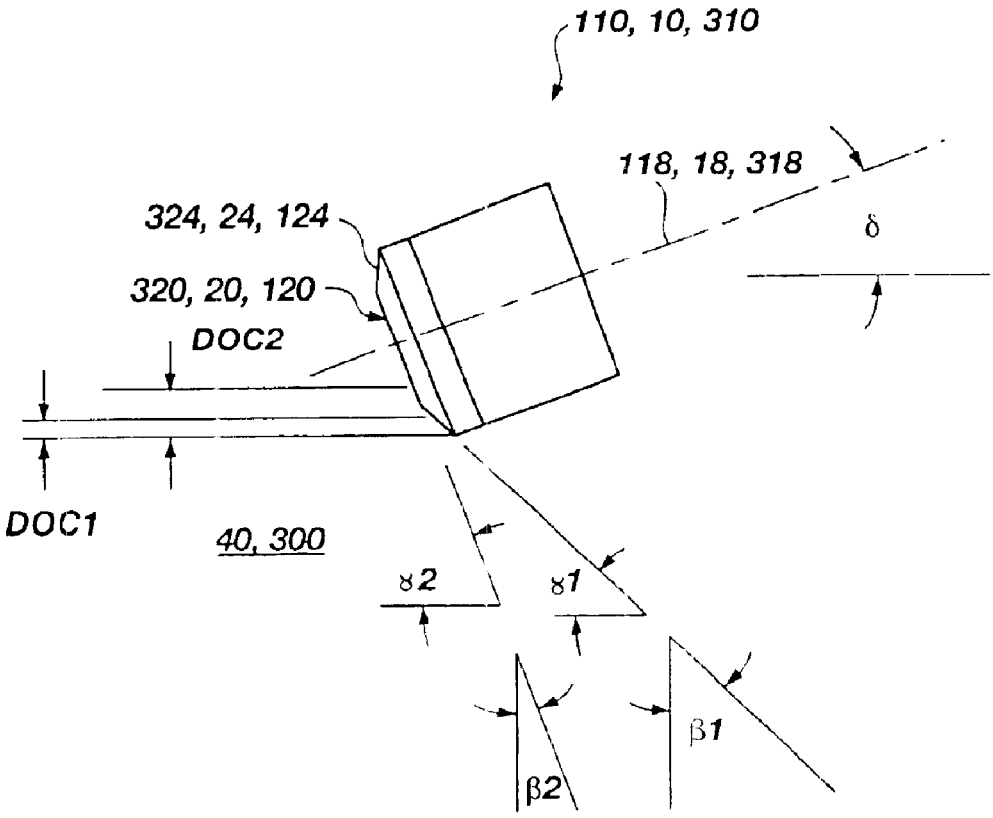
FIG. 11 comprises a side view of the preferred geometry of an exemplary PDC cutter which may be employed with the present invention.

Further, selection of the backrake angles δ of the cutters 110 themselves (as opposed to the backrake angles β1 of the chamfers 124) may be employed to predominantly determine the slopes of the ROP\ WOB and TOB\ WOB curves at high WOB and above the breaks in the curves, since the cutters 110 will be engaged with the formation to a DOC2 such that portions of the cutting face centers of the cutters 120 (i.e., above the chamfers 124) will be engaged with the formation 300. Since the central areas of the cutting faces 120 of the cutters 110 are oriented substantially perpendicular to the longitudinal axes 118 of the cutters 110, cutter backrake δ will largely dominate cutting face effective cutting face backrake angles (now β2) with respect to the formation 300, regardless of the chamfer rake angles β1. As noted previously, cutter rake angles δ may also be used to alter the chamfer rake angles β1 for purposes of determining bit performance during relatively low WOB drilling. Although the immediately preceding discussion of FIG. 11 is focused on large chamfer cutters 110, the same principles and concepts of selectively manipulating, or varying, the effective cutting face backrake angles to individually influence each cutter's aggressiveness apply to small chamfer cutters 10 as well as other suitable cutters 310 described herein.

It should be appreciated that appropriate selection of chamfer size and chamfer backrake angle of cutters having chamfers may be employed to optimize the performance of a drill bit with respect to the output characteristics of a downhole motor driving the bit during steerable, or nonlinear drilling of a borehole segment. Such optimization may be effected by choosing a chamfer size so that the bit remains nonaggressive under the maximum WOB to be applied during steerable or nonlinear drilling of the formation or formations in question, and choosing a chamfer backrake angle so that the torque demands made by the bit within the applied WOB range during such steerable drilling do not exceed torque output available from the motor, thus avoiding stalling.

With regard to the placement of cutters exhibiting variously-sized chamfers on the exterior and, specifically, the face of a bit, the chamfer widths employed on different regions of the bit face may be selected in proportion to cutter redundancy, or density, at such locations. For example, a center region of the bit, such as within a cone surrounding the bit centerline (see FIGS. 7 through 10 and above discussion) may have only a single cutter (allowing for some radial cutter overlap) at each of several locations extending radially outward from the centerline or longitudinal axis of the bit. In other words, there is only "single" cutter redundancy at such cutter locations. An outer region of the bit, portions of which may be characterized as comprising a nose, flank and shoulder, may, on the other hand, exhibit several cutters at substantially the same radial location. It may be desirable to provide three cutters at substantially a single radial location in the outer region, providing substantially triple cutter redundancy. In a transition region between the inner and outer regions, such as on the boundary between the cone and the nose, there may be an intermediate cutter redundancy, such as substantially double redundancy, or two cutters at substantially each radial location in that region.

Relating cutter redundancy to chamfer width for exemplary purposes in regard to the present invention, cutters at single redundancy locations may exhibit chamfer widths of between about 0.030 to 0.060 inch, while those at double redundancy locations may exhibit chamfer widths of between about 0.020 and 0.040 inch, and cutters at triple redundancy locations may exhibit chamfer widths of between about 0.010 and 0.020 inch. Rake angles of cutters in relation to their positions on the bit face have previously been discussed with regard to FIGS. 7 through 10. However, it will be appreciated that differences in the chamfer angles from the exemplary 45° angles discussed above may necessitate differences in the relative cutter backrake angles employed in, and within, the different regions of the bit face in comparison to those of the example.

Figure 12:
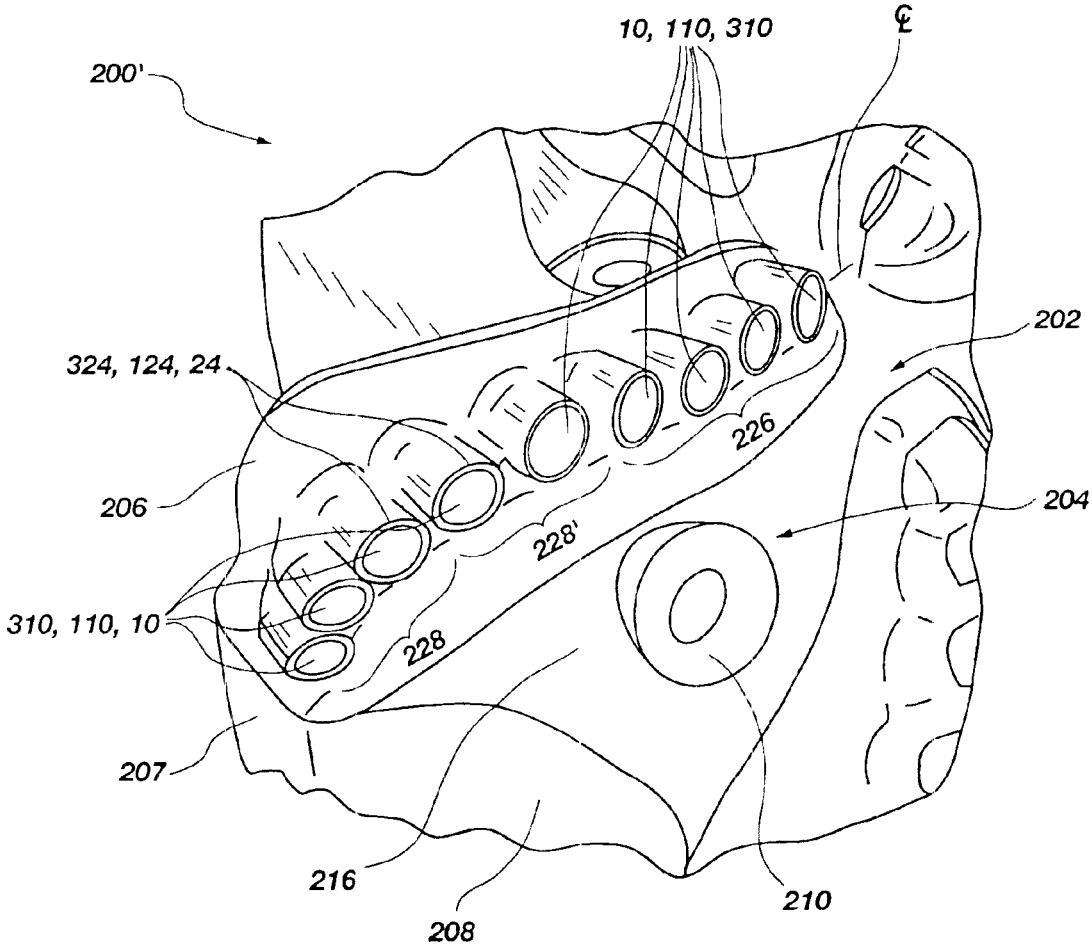
FIG. 12 comprises an enlarged, oblique face view of a single blade of a representative bit and illustrating cutters having different cutting face backrake angles in different regions along the face of the bit in accordance with the present invention.
Figure 13:
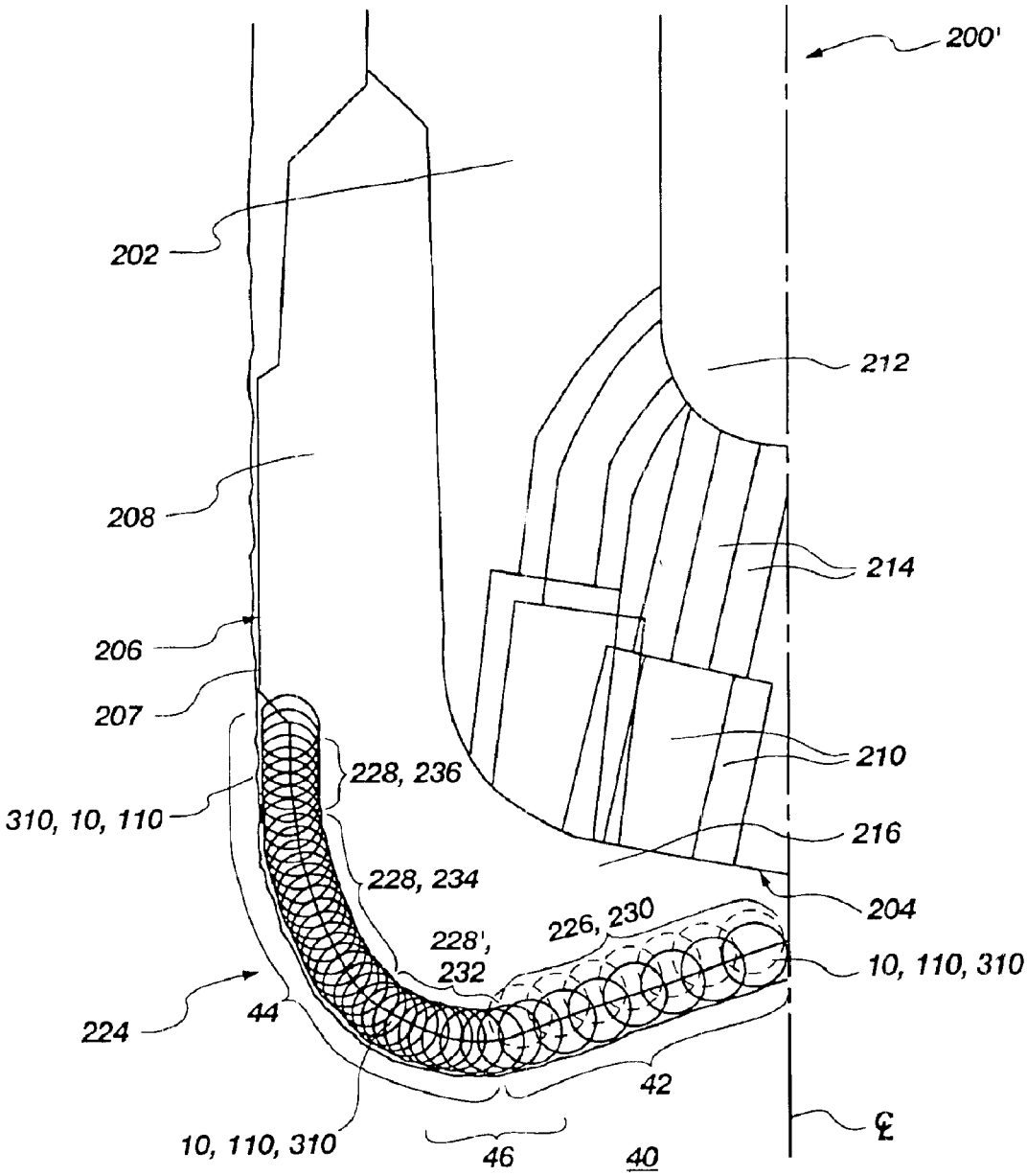
FIG. 13 comprises a quarter-sectional side view of a bit having an engineered cutter placement profile such as that of FIG. 12, with the cutter locations rotated to a single radius extending from the bit centerline to the gage to show the radial bit face locations of the cutter backrake angles employed in various regions of the bit as well as the optional chamfer sizes and angles employed in various regions of the bit.

A currently preferred embodiment of the present invention is illustrated in FIGS. 12 and 13 and test results of the currently preferred embodiment of the present invention as compared to two conventional bits are graphically presented in FIGS. 14A, 14B, 15A, and 15B. With particular reference to FIGS. 12 and 13, rotary drag bit 200' includes many of the elements and features of previously described and illustrated bit 200. Thus the reference numerals for elements and features which are common to bit 200 are used with respect to illustrating and describing bit 200'.

In accordance with the currently preferred embodiment, in addition to previously described small chamfer cutters 10 and large chamfer cutters 110, any suitable fixed superabrasive cutters 310 known within the art may be selectively positioned on bit 200' at selected effective cutting face backrake angles. Cutters 310 would thus encompass conventional PDC cutters having a superabrasive table of a preselected thickness including a cutting face mounted on any suitable substrate including, but not limited to, a tungsten carbide substrate. Cutters 310 may be provided with a chamfer of a preselected width and chamfer rake angle, as depicted in FIG. 11 with respect to exemplary cutter 110.

In accordance with the currently preferred embodiment, cutters 10, 110, and/or 310 are optimally positioned generally within respective regions along bit profile 224 of bit body 202 of bit 200'. Preferably, each cutter, whether it is to be a small chamfer cutter 10, a large chamfer cutter 110, or any other suitable cutter 310, will exhibit an effective cutting face backrake angle optimal for the general region in which it is located. That is, at least one of the plurality of the cutters located in first region 226, and preferably at least a majority of such cutters positioned in first region 226 which generally corresponds to cone region 230 of bit 200', exhibit respective effective cutting face backrake angles which may be characterized as being relatively nonaggressive. Such nonaggressive first region cutters will thus preferably exhibit relatively large negative effective cutting face backrake angles so as to less aggressively engage formation 40 in rock zone 42 while bit 200' is usually axially weighted at a WOB during drilling operations.

In contrast to the generally less aggressive cutters positioned generally in first region 226, or cone region 230, at least one of the plurality of the cutters, and preferably at least a majority of the cutters located in second region 228 which generally corresponds to flank 234 and shoulder 236 of bit 200', exhibit respective effective cutting face backrake angles which may be characterized as being relatively aggressive. Such aggressive second region cutters will thus preferably exhibit relatively small negative effective cutting face backrake angles so as to more aggressively engage formation 40 in rock zone 44 while bit 200' is rotated and usually subjected to a WOB during subterranean drilling operations.

With respect to cutters positioned radially intermediate of regions 226 and 228, third region 228' is provided with at least one cutter, and preferably at least a majority of the cutters provided in third region 228' which generally corresponds to nose 232 of bit 200', exhibiting respective effective cutting face backrake angles which may be characterized as being intermediately aggressive in comparison to the cutters positioned generally in first region 226 and second region 228. Such intermediately aggressive third region 228' cutters will thus preferably exhibit relatively moderate negative effective cutting face backrake angles. This will allow such third region cutters to engage formation 40 in rock zone 46 more aggressively than preferably a majority of the cutters located in first region 226 and less aggressively than preferably a majority of the cutters located in second region 228 while bit 200' is rotated and usually subjected to a WOB during subterranean drilling operations. It should also be understood that cutters provided in the various regions need not necessarily exhibit approximately the same or identical preferred effective cutting face backrake angles within the various regions. As an example, each cutter may be provided with a unique, mutually exclusive effective cutting face backrake angle within each region of each blade 206 or as taken as a collective, over the entire superimposed cutter profile extending from the longitudinal axis to the gage of the bit. That is, the respective, but optionally mutually differing effective cutting face backrake angles selected for each cutter located in any one region, may generally fall within a preferred range of effective cutting face backrake angles while maintaining a cutter backrake, or aggressiveness, profile which optimally and preferably includes least-aggressive cutters generally being disposed in first region 226, or cone region 230, most-aggressive cutters generally being disposed in second region 228, or flank 234 and/or shoulder 236, and intermediate-aggressive cutters generally being disposed in third region 228', or nose region 232 in accordance with the currently preferred embodiment of the present invention.

FIG. 12 of the drawings provides an isolated perspective view of a representative blade 206 including a plurality of representative PDC cutters disposed thereon. In accordance with the present invention, bit 200' may incorporate only small chamfer cutters 10, only larger chamfer cutters 110, only conventional or other known suitable cutters 310, or any combination thereof to result in a bit having an engineered cutter placement profile which may be characterized as being less aggressive in the first region radially proximate the longitudinal centerline, or axis, of the bit and which progressively becomes more aggressive as the cutter profile extends radially and longitudinally toward the gage of the bit. Thus, not only may the amount of cutter backrake angle δ, as depicted in FIG. 11, be manipulated or selected to provide a desired amount of cutter aggressiveness, or more precisely cutting face aggressiveness, wherein generally a numerically more negative cutter backrake angle yields less aggressiveness and wherein generally a numerically less negative, neutral, or more positive cutter backrake angles yield cutters of more aggressiveness, but a cutter having a superabrasive table configured with a generally peripherally extending chamfer exhibiting a selected width and exhibiting a backrake angle of a chamfer may also be provided. That is, as described above in context to exemplary cutter 110 in reference to FIG. 11, not only may large chamfer cutters 110 be optimally selected to exhibit a chamfer 124 of a preselected size oriented at a preselected backrake angle γ 1, but suitable cutters 310 may be incorporated and selectively positioned on the face of bit 200'. Such cutters 310 will preferably have a longitudinal axis 318 and a cutting face 320, generally perpendicular to longitudinal axis 318, which is oriented at a selected chamfer backrake angle δ with respect to formation 40. Although a cutter 310 need not be provided with a superabrasive table having a chamfer extending at least partially around the periphery thereof, for most applications it is preferred that a cutter 310 to be provided with a chamfer width of at least approximately 0.020 of an inch with the chamfer preferably oriented at a chamfer angle θ within a range of approximately 30° to approximately 60° with respect to longitudinal axis 318 to improve the break-in characteristics of such a cutter. A chamfer angle θ of approximately 45° is particular well suited for a wide variety of applications. Furthermore, suitable cutters 310 may feature chamfers 324 having a width intermediate to the respective ranges of widths as set forth above in regard to small width cutters 10 and large width cutters 110. Thus, suitable cutters 310, may optionally be provided chamfers of preselected widths and exhibiting preselected chamfer backrake angles δ which, in combination with cutter backrake angle δ, are selectively oriented to provide an effective cutting face backrake angle appropriate for the particular region of bit profile 224 in which each such suitable cutter is placed in accordance with the present invention.

The following are exemplary ranges of effective cutting face backrake angles for each of the various regions of bit 200' in which at least one cutter, and preferably at least a significant number of a plurality of cutters 10, 110, and/or 310 are positioned respectively within. For instance, one or more of the cutters disposed in first region 226, or cone 230, may have an effective cutting face backrake angle ranging from approximately negative 10° to approximately negative 65°. One or more of the cutters disposed in second region 228, or flank 234 and/or shoulder 236 may have an effective cutting face backrake angle ranging from approximately negative 10° to approximately 25°. One or more of the cutters disposed in third region 228' may have an effective cutting face backrake angle ranging from approximately negative 5° to approximately negative 30°.

The following exemplary cutter placement arrangement is also preferred. Approximately a majority of the cutters located in the first region 226, or cone 230, exhibit an effective cutting face backrake angle ranging from approximately negative 15° to approximately negative 30°. A majority of the cutters located in the second region 228, or flank 234 and/or shoulder 236 exhibit an effective cutting face backrake angle not exceeding, in a more negative manner, a backrake angle of approximately negative 10°. A majority of the cutters located in third region 228', or nose region 232, exhibit an effective cutting face backrake angle ranging from approximately negative 10° to negative 20°.

Yet another preferred cutter placement profile is as follows. At least approximately a majority of the cutters located in first region 226, or cone 230, exhibit an effective cutting face backrake angle of approximately 30°. At least a majority of cutters located in second region 228, or flank 234 and/or shoulder 236 exhibit an effective cutting face backrake angle of approximately 10°. At least a majority of cutters located in third region 228', or nose 232, exhibit an effective cutting face backrake angle of approximately 20°.

A still further additional preferred cutter placement profile is as follows. At least approximately a majority of the cutters located in first region 226, or cone 230, exhibit an effective cutting face backrake angle of approximately 7°. At least a majority of cutters located in second region 228, or flank 234 and/or shoulder 236 exhibit an effective cutting face backrake angle of approximately 10°. At least a majority of cutters located in third region 228', or nose 232, exhibit an effective cutting face backrake angle of approximately 15°.

It should be noted that the extent of the particular regions of bit 200' which have been depicted in FIGS. 12 and 13 may vary from that as illustrated. For example, bit profile 224 may have a substantially different overall configuration than that as shown therein.

Furthermore, the individual extent, or span, of the various regions may vary significantly as from the representative extents illustrated in FIGS. 12 and 13. Thus, the identified regions may be further broken into more specific regions, or subregions, or alternatively no reference need be given with respect to any regions. For example, a cutter profile may be comprised of less aggressive cutters positioned radially proximate the longitudinal axis of the bit with progressively more aggressive cutters being placed along the more radially distant portions of the face toward the gage of the bit. That is, each cutter of such a progressively more aggressive cutter profile may be provided with an effective cutting face backrake angle which would not necessarily be based upon the particular region of the bit in which the cutter is located, but instead each cutter would exhibit a more aggressive effective cutting face backrake angle than the immediately radially adjacent cutter positioned closer to the longitudinal axis of the bit. Thus, the aggressiveness of each cutter may optionally be referenced directly upon the radial, or lateral, distance in which each cutter is placed from the longitudinal axis of the bit in lieu of being based upon a particular region in which it is placed to provide a progressively more aggressive, yet "regionless," cutter profile. Stated differently, the aggressiveness each cutter is to have may be selected by the drill bit designer in light of the expected load to be placed on each cutter so as to control the amount of torque each such cutter will generate upon each such cutter experiencing the expected load regardless or secondary to the actual radial position of each cutter. By optimally selecting the amount of aggressiveness each cutter is to have, the ROP of the bit will be maximized while also minimizing the amount of wear and potential damage that each cutter will likely experience. That is, if a given cutter at a given location on the face of a bit is expected to be subjected to a relatively high axial load as it engages a formation, the effective backrake angle for such cutter, and/or the aggressiveness exhibited by the cutter, will be selected so as to ideally render an appropriate, or proportional degree of aggressiveness for the anticipated axial load to be placed on such cutter. For example, in accordance with the present invention, cutters located radially proximate the longitudinal axis of a drag bit are frequently expected to be subjected to large amounts of axial load and therefore are provided with a relatively low degree of aggressiveness. Cutters located more radially distant the longitudinal axis are frequently expected to be subjected to small amounts of axial load and may therefore be provided with a high degree of aggressiveness. Cutters located radially intermediate distances from the longitudinal axis of the bit will frequently be expected to be subjected to intermediate levels of axial loads and thus may be provided with an intermediate degree of aggressiveness. Optionally, each cutter may be oriented or selected to have features which render each cutter progressively more aggressive in relation to the radial distance from the longitudinal axis in which each such cutter is positioned, or placed.

As discussed previously herein, if a cutter is to have a chamfer, the width and backrake angle exhibited by such a chamfer will significantly influence the effective cutting face backrake angle as per the above discussions relating to FIG. 11. In accordance with a presently preferred embodiment of the invention, positioning cutters having selectively sized and oriented chamfers may either separately, or in combination, with selectively manipulating or varying the cutter backrake angle, provide a tool bit designer with the ability to selectively place, or dispose, cutters of a selected aggressiveness directly on the face or upon bladed structures of rotary drag bits either in relation to readily identifiable regions of the bit, in relation to the radial distance from the longitudinal axis each cutter is disposed, and/or in relation to at least the anticipated, or expected, axial loads to be placed upon each cutter.

Thus, referring generally to FIGS. 11, 12, and 13, an additional aspect of the present invention includes a bit, such as a rotary drag bit 200', having a plurality of cutters, such as cutters 10, 110, and/or 310 disposed over at least a portion of the drill bit, such as on selected surfaces of blade structures 206 which are intended to face a subterranean formation when bit 200' is placed in service. By selectively disposing, or placing, cutters at selected cutter backrake angles δ, having chamfers, such as chamfers 24, 124, and/or 324 of a selected width, such as chamfers 24, 124, and/or 324, which are selectively angled with respect to the longitudinal axis of the cutter, such as longitudinal axes 18, 118, and/or 318, by an angle θ, within for example, various regions of the bit, such as first, second, and third regions 226, 228, and 228', bit 200' will then exhibit a cutter placement profile of a desired aggressiveness that may be tailored for optimizing the ROP of the bit while minimizing the resultant TOB for the range of WOB that the bit is intended to be operated. In other words, the chamfer width, chamfer angle, geometry, and cutter backrake angles of cutters disposed along the face of the bit may be selectively manipulated to provide cutter placement profile wherein at least some, and preferably every cutter exhibits an appropriate aggressiveness for its location along bit profile 224.

To further elaborate, chamfers such as chamfers 24, 124, and/or 324 and which have a small width, large width, or another suitable width, may be manipulated to greatly, if not primarily, influence the aggressiveness of each cutter provided with a chamfer. Therefore, in accordance with another embodiment of the present invention, preferably at least some of the cutters in first region 226 generally radially proximate the longitudinal axis of the bit, such as in cone 230 of the bit, have chamfers oriented, as measured with respect to the longitudinal axis of each cutter, between approximately 30° to approximately 60° with 45° being particularly suitable for a wide variety of applications. Furthermore, at least some of the cutters having chamfers generally in first region 226, the width of the chamfers preferably ranges between about 0.030 of an inch to about 0.060 of an inch. For those cutters having chamfers which are positioned on the bit face in second region 228 which generally encompasses flank 234 and shoulder 236 of the bit and extending outward toward the gage region of the bit, the chamfers are preferably not as wide, with chamfer widths preferably ranging between about 0.005 of an inch to about 0.020 of an inch to increase the overall aggressiveness of second region 228 of bit 200'. The individual angle of the chamfers of at least some of the cutters generally disposed in second region 228, as measured with respect to the longitudinal axis of the cutters, ranges between approximately 30° and about 60° with approximately 45° being particularly suitable for many applications. Additionally, cutters having chamfers disposed generally in third region 228' of the bit exhibit chamfer widths intermediate the chamfer widths of cutters having chamfers in the first and second regions. That is, at least some of the cutters having chamfers which are positioned, or disposed, with third region 228', such as nose 232, have chamfer widths that are smaller than the chamfer widths of at least some of the cutters disposed in the first, or cone, region of the bit but have chamfer widths that are larger than the chamfer widths of at least some of the cutters having chamfers that are positioned in the second region of the bit located more radially outward toward the gage of the bit. Thus, a bit embodying such a cutter profile may preferably employ a preselected number of large chamfer cutters 110 generally within region 226, a preselected number of small chamfer cutters 10 generally within region 228, and a preselected number of cutters 310 provided with chamfers sized intermediately of cutters 10 and 110 generally within region 228'. Alternatively, cutters having selectively sized and angled chamfers may be placed along the bit profile such that chamfer size of the cutters decreases progressively in relation to the radial distance in which each cutter is located from the longitudinal axis of the bit. Similarly, cutters having selectively angled backrakes may be placed along the bit profile such that magnitude of backrake of the cutters decreases progressively in relation to the radial distance in which each cutter is located from the longitudinal axis of the bit, thus becoming increasingly aggressive in relation to the radial distance in which each cutter is located from the longitudinal axis of the bit.

It will now be apparent that aggressiveness of an individual cutter may be tailored by selectively varying at least one of the effective cutting face backrake angle, the cutter backrake angle, whether the cutter is to have a chamfer and if so the chamfer size and the chamfer angle thereof, and by selectively placing cutters of selected aggressiveness along the face of the bit, and preferably upon bladed structures provided on a bit, to render a bit with an engineered cutter placement profile which will offer enhanced performance and wear characteristics as compared to priorly known bits. Such enhanced performance may be measured in terms of ROP, TOB, within the working WOB of a bit as illustrated in the graphically portrayed test results of FIGS. 14A, 14B, 15A, and 15B in which a bit embodying the present invention is contrasted with the test results of two representative, conventional bits.

FIGS. 14A–15B graphically portray the test results of an exemplary bladed style rotary drag bit "A," such as drill bit 200', having a cutter profile in which the cutters located generally in the cone of the bit were oriented with an effective cutting face backrake angle of approximately negative 7°, the cutters located generally in the flank and shoulder of the bit were oriented with an effective cutting face backrake angle of approximately negative 10°, and the cutters located generally in the nose of the bit were oriented at approximately negative 15°. That is, the cutting faces of the cutters were oriented at the listed angles as measured with respect to a line generally perpendicular to the formation to be engaged, as taken in the direction of intended bit rotation so as to exhibit progressively more aggressiveness along the bit profile as discussed above. The test results of a conventional bladed style rotary drag bit "B" having essentially all of its cutters oriented so as each cutter exhibited an effective cutting face backrake angle of approximately negative 10° is plotted on each of the graphs. A third conventional bladed style rotary drag bit "C" having essentially all of its cutters oriented so as each cutter exhibited an effective cutting face backrake angle of approximately negative 20° was also tested and the results plotted on graphs 14A through 15B. Each of the tested bits were rotated at the same rotational rate of approximately 120 revolutions per minute (120 RPM) and both test formations had a formation containment pressure of 1,100 psi during testing.

Figure 14A:
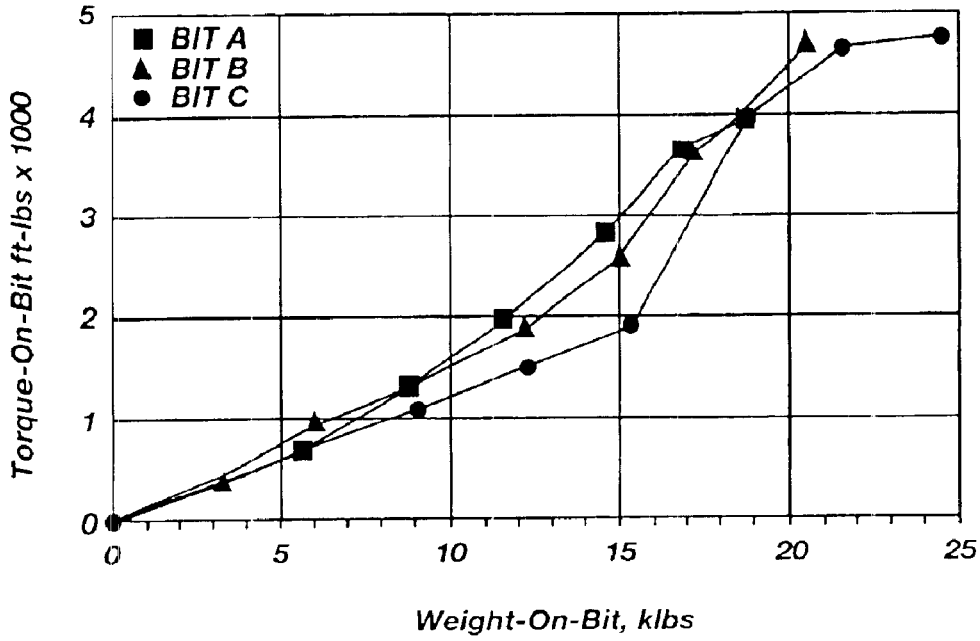
FIG. 14A is a graphical representation of TOB vs. WOB test results of laboratory drilling tests conducted in a formation of Carthage limestone of an exemplary bit incorporating the present invention as compared to two representative conventional bits.
Figure 14B:
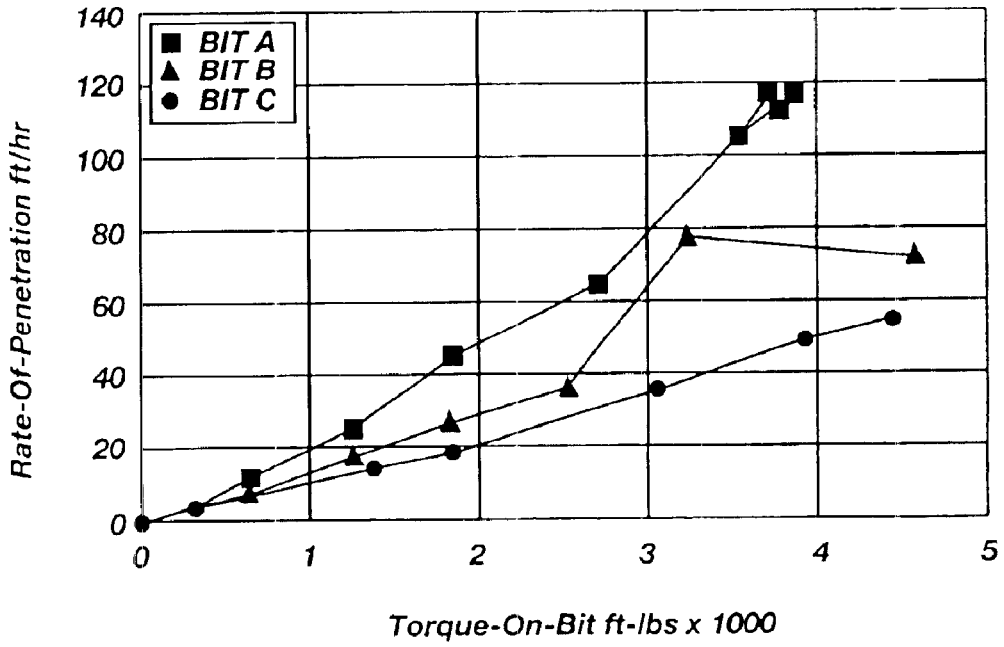
FIG. 14B is a graphical representation of ROP vs. TOB test results of laboratory drilling tests conducted in a formation of Carthage limestone of the bit incorporating the present invention as compared to the two representative conventional bits.

FIGS. 14A and 14B pertain to test results of the bits as tested in a formation of Carthage limestone with the test results in FIG. 14A being plotted with respect to torque-on-bit (TOB) in the units of thousands of foot-pounds versus weight-on-bit (WOB) in the units of thousands of pounds. The test results in FIG. 14B are plotted with respect to rate-of-penetration (ROP) in the units of foot per hour versus torque-on-bit (TOB) in the units of thousands of foot-pounds.

Figure 15A:
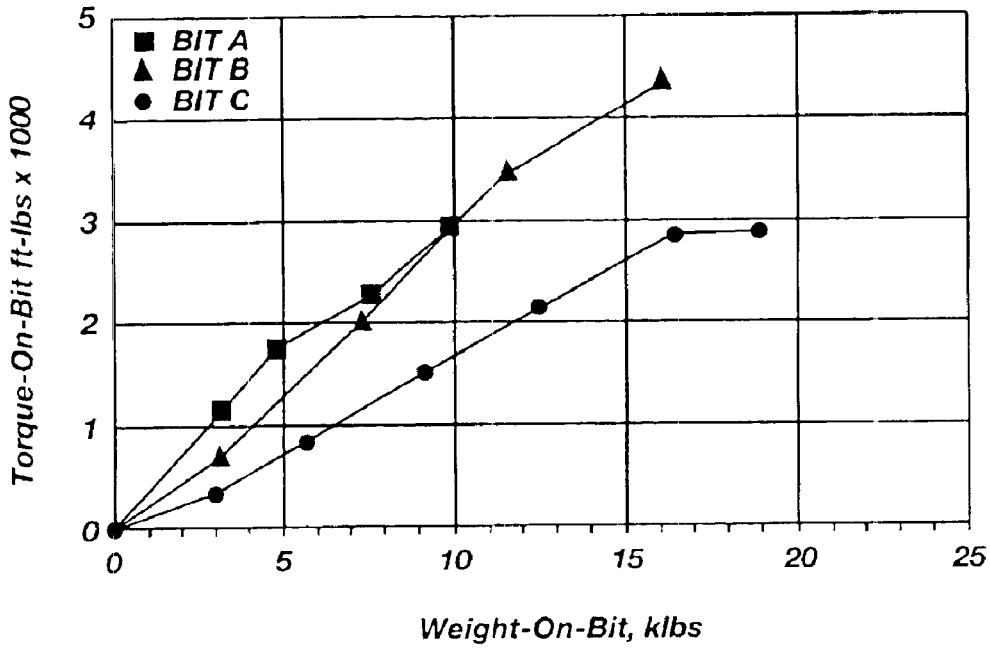
FIG. 15A is a graphical representation of TOB vs. WOB test results of laboratory drilling tests conducted in a formation of Catoosa shale of the bit incorporating the present invention as compared to the two representative conventional bits.
Figure 15B:
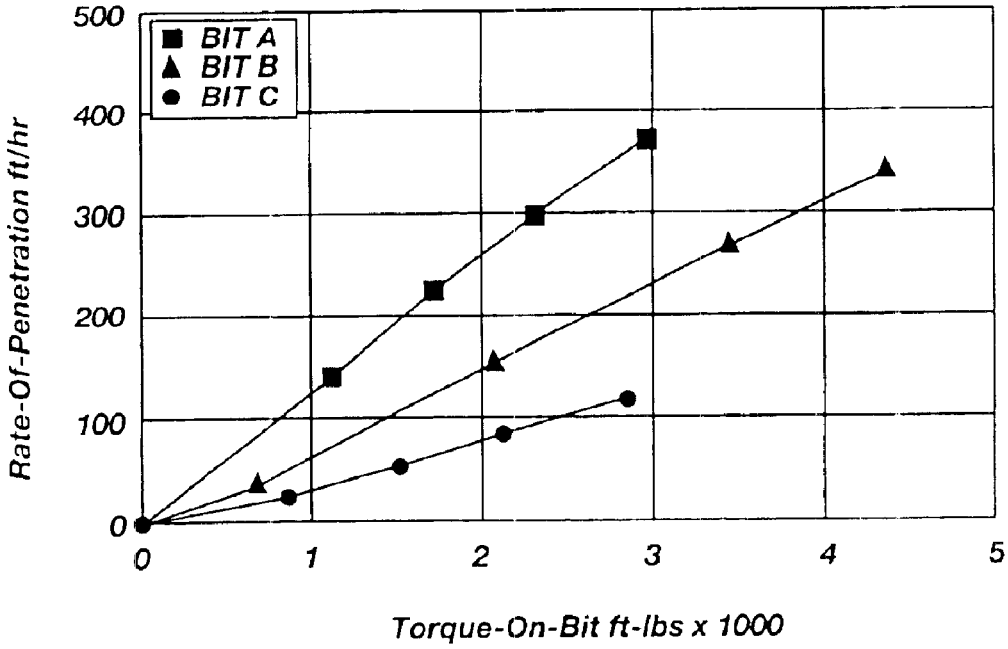
FIG. 15B is a graphical representation of ROP vs. TOB test results of laboratory drilling tests conducted in a formation of Catoosa shale of the bit incorporating the present invention as compared to the two representative conventional bits.

FIGS. 15A and 15B pertain to test results of the bits as tested in a formation of Catoosa shale with the test results in FIG. 15A being plotted with respect to torque-on-bit (TOB) in the units of thousands of foot-pounds versus weight-on-bit (WOB) in the units of thousands of pounds. The test results in FIG. 15B are plotted with respect to rate-of-penetration (ROP) in the units of foot per hour versus torque-on-bit (TOB) in the units of thousands of foot-pounds.

As can be seen in FIG. 14A, the plot of bit "A" may be described as having generated a TOB that increases generally linearly as the WOB is increased. Contrastingly, conventional bits "B" and especially "C" have plots that exhibit a lower slope for WOB less than 15,000 pounds, and generated TOB values that tend to rise dramatically when the WOB is increased beyond approximately 15,000 pounds. However, as can more easily be seen, and possibly of greater significance with respect to the present invention are the respective plots of bit "A" and conventional bits "B" and "C" of FIG. 14B.

As can be seen in FIG. 14B the plot of bit "A" exhibits a very desirable (i.e. high) ROP at an associated, relatively low TOB. Such a desirable ROP vs. TOB plot for bit "A" offers enhanced performance in terms of lower drilling costs, quicker borehole drilling times to a target depth, and may also result in longer bit life in suitable formations. In contrast, conventional bits "B" and "C" tend to offer generally less performance in terms of ROP while generating higher associated values of TOB. For example, bit "C" at a ROP of approximately 40 ft/hr generated approximately 78% more TOB than did bit "A" when drilling at the same ROP of approximately 40 ft/hr.

The test results depicted in FIGS. 15A and 15B, in which exemplary bit "A" and conventional bits "B" and "C" were tested in Catoosa shale, further confirm and generally coincide with FIGS. 14A and 14B as to the benefits and enhanced performance that bits embodying the present invention may offer the industry. For example, bit "C" when yielding a ROP of approximately 100 ft/hr generated approximately 3 times the amount TOB than did bit "A" when drilling at the same ROP of approximately 100 ft/hr in Catoosa Shale.

Figure 16A:
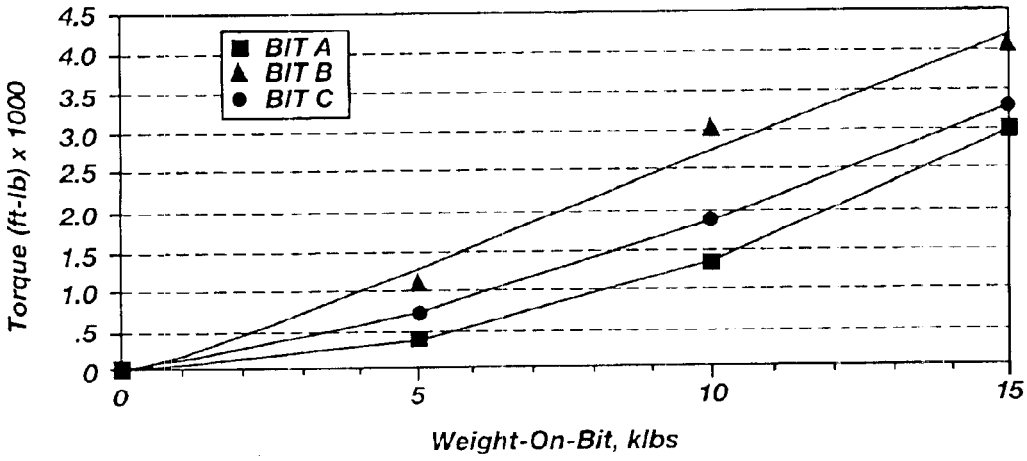
FIG. 16A is a graphical representation of TOB vs. WOB test results of laboratory drilling tests conducted in a formation of Catoosa shale of a bit incorporating the present invention as compared to two representative conventional bits.
Figure 16B:
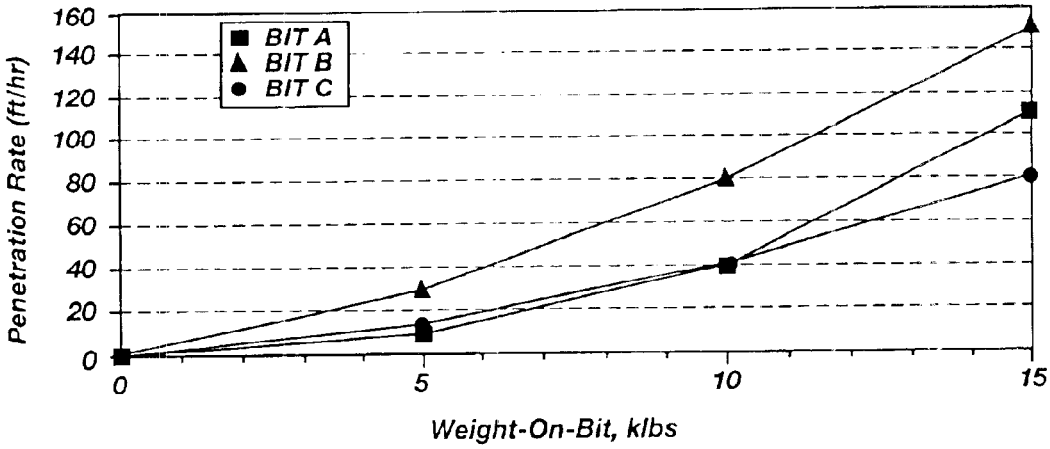
FIG. 16B is a graphical representation of ROP vs. WOB test results of laboratory drilling tests conducted in a formation of Catoosa shale of the bit incorporating the present invention as compared to the two representative conventional bits.

The enhanced performance, measured in terms of ROP, TOB, and WOB is illustrated in the graphically portrayed test results as shown in FIGS. 16A and 16B of a further embodiment of the present invention. Specifically, FIGS. 16A and 16B show performance data of a drill bit "A," such as drill bit 200', of the present invention, configured with DIAX® cutters, available from Hughes Christensen Company of Houston, Tex., having a cutter profile in which the cutters located generally in the cone of the bit were oriented with an effective cutting face backrake angle of approximately negative 20°, the cutters located generally in the nose of the bit were oriented with an effective cutting face backrake angle of approximately negative 10°, and the cutters located generally on the shoulder of the bit were oriented at approximately negative 15°. That is, the cutting faces of the cutters were oriented at the listed angles as measured with respect to a line generally perpendicular to the formation to be engaged, as taken in the direction of intended bit rotation so as to exhibit desired aggressiveness along the bit profile. More particularly, a drill bit so configured may exhibit characteristics desirable for directional drilling, yet exhibit lower torque requirements than conventional bits. The test results of a conventional bladed style rotary drag bit "B" having essentially all of its cutters oriented so as each cutter exhibited an effective cutting face backrake angle of approximately negative 20° is plotted on each of the graphs. A third conventional bladed style rotary drag bit "C" having essentially all of its cutters oriented so as each cutter exhibited an effective cutting face backrake angle of approximately negative 30° was also tested and the results plotted on graphs 16A through 17C. Each of the tested bits were rotated at the same respective rotational rate during each test and the formations exhibited the same respective containment pressures for the bits during each test.

FIGS. 16A and 16B pertain to test results of the bits as tested in a formation of Catoosa shale with the test results in FIG. 16A being plotted with respect to torque-on-bit (TOB) in the units of thousands of foot-pounds versus weight-on-bit (WOB) in the units of thousands of pounds. The test results in FIG. 16B are plotted with respect to rate-of-penetration (ROP) in the units of foot per hour versus weight-on-bit (WOB) in the units of thousands of pounds.

As can be seen in FIG. 16A the plot of bit "A" exhibited a very desirable high ROP at an associated, relatively low TOB. Such a desirable ROP vs. TOB plot for bit "A" offers enhanced performance in terms of directional drilling control as well as reduced torque requirements. In contrast, conventional bits "B" and "C" tend to require generally higher TOB at a given WOB. For example, bit "B" at a WOB of approximately 10,000 pounds generated approximately 211% more TOB than did bit "A" when drilling at the same WOB of approximately 10,000.

Figure 17A:
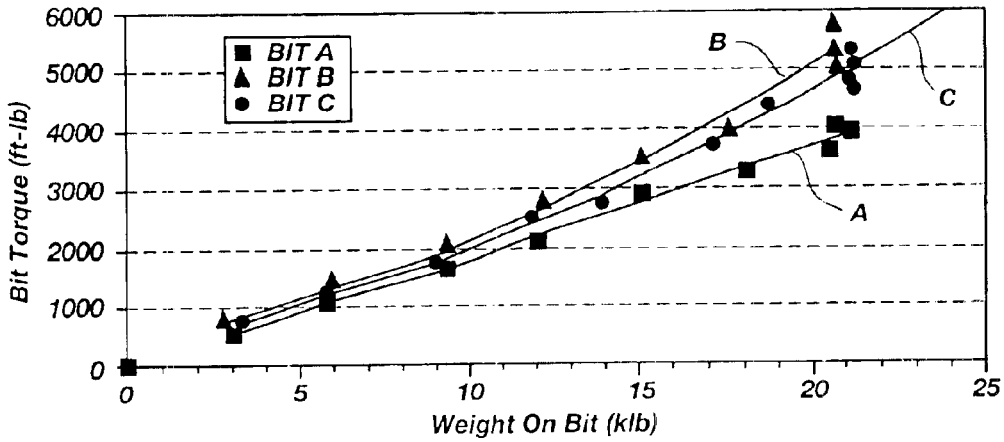
FIG. 17A is a graphical representation of TOB vs. WOB test results of laboratory drilling tests conducted in a formation of Bedford limestone of a bit incorporating the present invention as compared to two representative conventional bits.
Figure 17B:
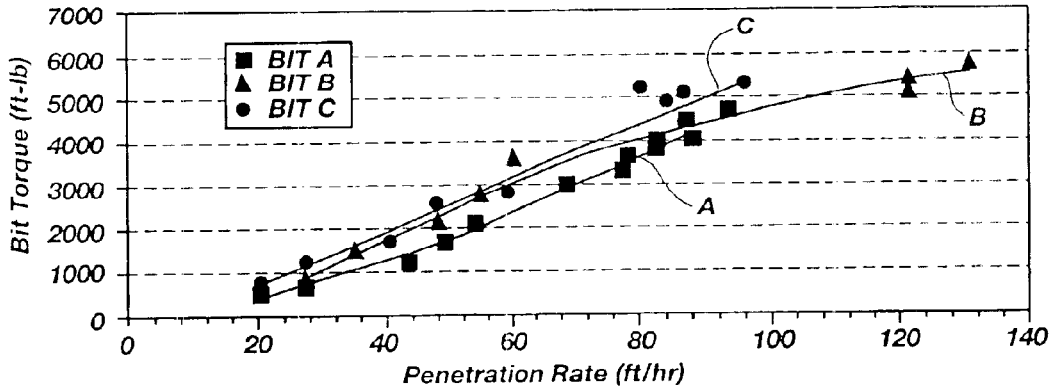
FIG. 17B is a graphical representation of TOB vs. ROP test results of laboratory drilling tests conducted in a formation of Bedford limestone of the bit incorporating the present invention as compared to the two representative conventional bits.
Figure 17C:
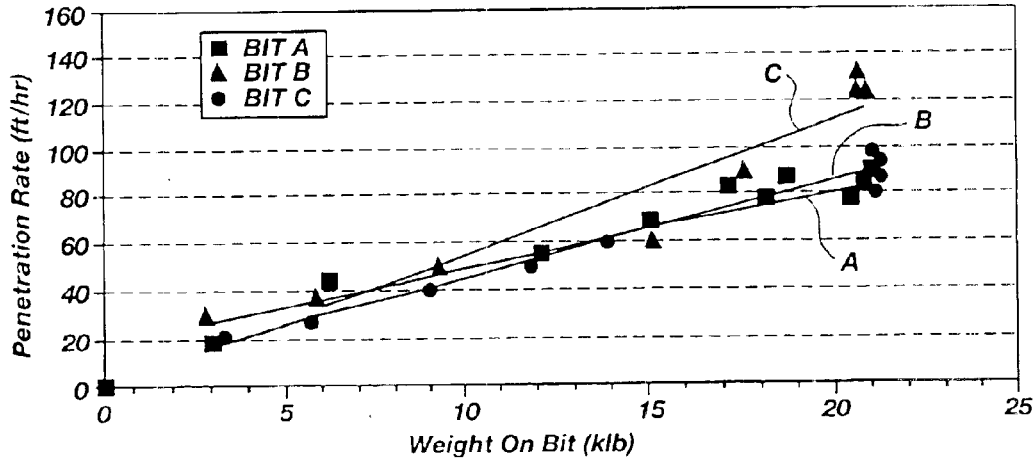
FIG. 17C is a graphical representation of ROP vs. WOB test results of laboratory drilling tests conducted in a formation of Bedford limestone of the bit incorporating the present invention as compared to the two representative conventional bits.

Similarly, FIGS. 17A through 17C refer to test results of the bits as tested in a formation of Bedford limestone with the test results in FIG. 17A being plotted with respect to torque-on-bit (TOB) in the units of thousands of foot-pounds versus weight-on-bit (WOB) in the units of thousands of pounds. The test results in FIG. 17C are plotted with respect to rate-of-penetration (ROP) in the units of feet per hour versus weight-on-bit (WOB) in the units of thousands of pounds. The test results in FIG. 17B are plotted with respect to TOB in the units of thousands of foot pounds versus ROP in the units of feet per hour.

As shown in FIG. 17A, drill bit "A" exhibits advantageously lower torque than conventional bits "B" and "C" as a function of WOB. Further, as shown in FIG. 17B, bit "A" exhibits lower torque as a function of ROP, thus, for a given penetration rate, thus, bit "A" drills more efficiently than does bit "B" or "C" for a given penetration rate. Furthermore, bit "A" may exhibit directional drilling characteristics similar to drill bit "C," configured with negative 30° backrake cutters. The present invention, as shown by drilling data associated with bit "A" may provide more efficient drilling characteristics in terms of torque response while also providing desirable directional drilling characteristics.

While the present invention has been described and illustrated herein, those of ordinary skill in the art will understand and appreciate the present invention is not so limited, and many additions, deletions, combinations, and modifications may be effected to the invention as described and illustrated without departing from the scope of the invention as hereinafter claimed.

What is claimed is:

1. A rotary drag bit for drilling a subterranean formation, comprising:

a bit body having a longitudinal axis and extending radially outward therefrom to a gage, the bit body further comprising at least a first region, a second region, and a third region, radially intermediate the first and second regions, extending over a face of the bit body to be oriented toward the subterranean formation during drilling; and a plurality of cutters located on the bit body in the first, second, and third regions, the cutters each comprising a superabrasive cutting face of a preselected geometry and including a preselected effective cutting face backrake angle with respect to a line generally perpendicular to the subterranean formation, as taken in the direction of intended bit rotation, and wherein the respective superabrasive cutting faces of a majority of cutters located in the first region exhibit substantially more negative effective cutting face backrake angles than the effective cutting face backrake angles of the respective superabrasive cutting faces of a majority of cutters located in the second and third regions.

2. The rotary drag bit of claim 1, wherein the first region lies within a cone of the face of the bit body, the second region extends over at least a flank on the face of the bit body, and the third region extends over at least a nose of the face of the bit body.

3. The rotary drag bit of claim 2, wherein the second region extends to the gage of the bit body.

4. The rotary drag bit of claim 2, wherein at least about half of the plurality of cutters located in the first region exhibit an effective cutting face backrake angle within a range of approximately negative 10° to approximately negative 45°, at least about half of the plurality of cutters located in the second region exhibit an effective cutting face backrake angle not more negative than approximately negative 15°, and at least about half of the plurality of cutters located in the third region exhibit an effective cutting face backrake angle within a range of approximately negative 5° to approximately negative 30°.

5. The rotary drag bit of claim 2, wherein at least about half of the plurality of the cutters located in the first region exhibit an effective cutting face backrake angle within a range of approximately negative 15° to approximately negative 30°, at least about half of the plurality of the cutters located in the second region exhibit an effective cutting face backrake angle not more negative than approximately negative 10°, and at least about half of the plurality of the cutters located in the third region exhibit an effective cutting face backrake angle within a range of approximately negative 10° to approximately negative 20°.

6. The rotary drag bit of claim 2, wherein at least about half of the plurality of cutters located in the first region exhibit an effective cutting face backrake angle of approximately negative 30°.

7. The rotary drag bit of claim 2, wherein at least about half of the plurality of cutters located in the second region exhibit an effective cutting face backrake angle of approximately negative 10°.

8. The rotary drag bit of claim 2, wherein at least about half of the plurality of cutters located in the second region exhibit an effective cutting face backrake angle not more negative than approximately negative 15°.

9. The rotary drag bit of claim 2, wherein at least about half of the plurality of cutters located in the third region exhibit an effective cutting face backrake angle of approximately negative 20°.

10. The rotary drag bit of claim 2, wherein at least about half of the plurality of cutters located in the first region exhibit an effective cutting face backrake angle of approximately negative 30°, at least about half of the plurality of cutters located in the second region exhibit an effective cutting face backrake angle of approximately negative 10°, and at least about half of the plurality of cutters located in the third region exhibit an effective cutting face backrake angle of approximately negative 20°.

11. The rotary drag bit of claim 2, wherein at least about half of the plurality of cutters located in the second region exhibit an effective cutting face backrake angle of approximately negative 15°.

12. The rotary drag bit of claim 2, wherein at least about half of the plurality of cutters located in the first region exhibit an effective cutting face backrake angle of approximately negative 20°.

13. The rotary drag bit of claim 2, wherein approximately at least about half of the plurality of cutters located in the third region exhibit an effective cutting face backrake angle of approximately negative 10°.

14. The rotary drag bit of claim 2, wherein the respective superabrasive cutting faces of the majority of cutters located in the second region exhibit less negative effective cutting face backrake angles than the effective cutting face backrake angles of the respective superabrasive cutting faces of the majority of cutters located in the third region.

15. The rotary drag bit of claim 14, wherein at least about half of the plurality of cutters located in the first region exhibit an effective cutting face backrake angle of approximately negative 20°, at least about half of the plurality of cutters located in the second region exhibit an effective cutting face backrake angle of approximately negative 15°, and at least about half of the plurality of cutters located in the third region exhibit an effective cutting face backrake angle of approximately negative 10°.

16. The rotary drag bit of claim 2, wherein the first region comprises a plurality of cutters having chamfers, the second region comprises a plurality of cutters having chamfers, and the third region comprises a plurality of cutters having chamfers wherein the plurality of first region cutters include chamfers oriented at negative chamfer backrake angles more negative than chamfer backrake angles of the chamfers of the plurality of second and third region cutters having chamfers.

17. The rotary drag bit of claim 16, wherein the bit body further includes a plurality of generally radially oriented blades extending generally longitudinally over the face toward the gage, and wherein the first region cutters, the second region cutters, and the third region cutters are located on the blades.

18. The rotary drag bit of claim 16, wherein the effective cutting face backrake angles of the plurality of cutters are determined at least in part by cutter backrake angles of the cutters.

19. The rotary drag bit of claim 16, wherein at least one first region cutter, at least one second region cutter, and at least one third region cutter each include a chamfer having a preselected chamfer backrake angle at a cutting face periphery, and wherein the chamfer backrake angles of the at least one first region cutter, the at least one second region cutter, and the at least one third region cutter are mutually different.

20. The rotary drag bit of claim 16, wherein each of the plurality of cutters include a respective longitudinal axis, and the chamfers of the first region cutters having chamfers, the second region cutters having chamfers, and the third region cutters having chamfers are disposed at substantially equal angles to their respective longitudinal axes.

21. The rotary drag bit of claim 20, wherein the chamfers of the first, second, and third region cutters having chamfers are disposed at approximately 45° with respect to their respective longitudinal axes.

22. The rotary drag bit of claim 16, wherein at least some of the cutters of the first region having chamfers exhibit chamfer widths substantially larger than at least some of the chamfers of the cutters in the second region having chamfers.

23. The rotary drag bit of claim 22, wherein at least some of the cutters of the third region having chamfers exhibit chamfer widths intermediate chamfer widths of at least some of the cutters in the first and second regions having chamfers.

24. The rotary drag bit of claim 22, wherein at least some of the cutters of the first region having chamfers exhibit chamfer widths within a range of approximately 0.030 of an inch to approximately 0.060 of an inch.

25. The rotary drag bit of claim 24, wherein at least some of the cutters of the second region having chamfers exhibit chamfer widths within a range of approximately 0.005 of an inch to approximately 0.020 of an inch.

26. The rotary drag bit of claim 22, wherein at least some of the cutters of the second region having chamfers exhibit chamfer widths within a range of approximately 0.005 of an inch to approximately 0.020 of an inch.

27. The rotary drag bit of claim 1, wherein at least some of the superabrasive cutting faces are disposed on polycrystalline diamond compact tables.

28. The rotary drag bit of claim 27, wherein at least some of the polycrystalline diamond compact tables are supported by metallic substrates.

29. The rotary drag bit of claim 28, wherein at least some of the polycrystalline diamond compact tables are supported by tungsten carbide substrates.

30. The rotary drag bit of claim 1, wherein at least some of the plurality of cutters include superabrasive cutting faces generally perpendicular to a longitudinal axis of the at least some of the plurality of cutters.

31. A rotary drag bit for drilling a subterranean formation, comprising:

a bit body having a longitudinal axis and extending radially outward therefrom to a gage, the bit body further comprising a first region radially proximate the longitudinal axis, a second region radially proximate the gage, and a third region radially intermediate the first and second regions, and a plurality of circumferentially spaced blade structures wherein at least some of the plurality of circumferentially spaced blade structures extend longitudinally along a face of the bit body from generally the first region through the third region to generally the second region; and a plurality of cutters having preselected cutter backrake angles carried by at least some of the plurality of circumferentially spaced blade structures and being positioned within each of the three regions of the bit body, the plurality of cutters each comprising a longitudinal axis and at least one primary superabrasive cutting face having a preselected size and geometry and being positioned substantially transverse to a direction of cutter movement during drilling;

wherein a majority of the cutters located in the first region are oriented within a first range of relatively more aggressive cutter backrake angles, a majority of the cutters located in the second region are oriented within a second range of relatively less aggressive cutter backrake angles, and a majority of the cutters located in the third region are oriented within a third range of relatively intermediately aggressive cutter backrake angles; and wherein the first region comprises a plurality of cutters having chamfers, the second region comprises a plurality of cutters having chamfers, and the third region comprises a plurality of cutters having chamfers.

32. The rotary drag bit of claim 31, wherein the first range of relatively more aggressive cutter backrake angles includes cutters having a backrake from approximately negative 5° to approximately negative 15°, the second range of relatively less aggressive cutter backrake-angles includes cutters having a backrake not more negative than approximately a negative 45°, and the third range of relatively intermediately aggressive cutter backrake angles includes cutters having a backrake from approximately negative 10° to approximately negative 30°.

33. The rotary drag bit of claim 31, wherein the first range of relatively more aggressive cutter backrake angles includes cutters having a backrake from approximately negative 5° to approximately negative 15°, the second range of relatively less aggressive cutter backrake angles includes cutters having a backrake not more negative than approximately negative 30°, and the third range of relatively intermediately aggressive cutter backrake angles includes cutters having a backrake from approximately negative 10° to approximately negative 20°.

34. The rotary drag bit of claim 31, wherein the majority of the cutters located in the first region have a cutter backrake angle of approximately negative 7°, the majority of the cutters located in the second region have a cutter backrake angle of approximately negative 15°, and the majority of the cutters located in the third region have a cutter backrake angle of approximately negative 10°.

35. The rotary drag bit of claim 31, wherein the majority of the cutters located in the first region have a cutter backrake angle of approximately negative 10°, the majority of the cutters located in the second region have a cutter backrake angle of approximately negative 20°, and the majority of the cutters located in the third region have a cutter backrake angle of approximately negative 15°.

36. The rotary drag bit of claim 31, wherein the at least one primary superabrasive cutting face of each of the plurality of cutters is disposed on polycrystalline diamond compact tables.

37. The rotary drag bit of claim 36, wherein the polycrystalline diamond compact tables are supported by metallic substrates.

38. The rotary drag bit of claim 37, wherein the metallic substrates comprise tungsten carbide.

39. The rotary drag bit of claim 31, wherein at least some of the plurality of cutters exhibit superabrasive cutting faces having at least a substantial portion thereof generally perpendicular to the longitudinal axis of the at least some of the plurality of cutters.

40. The rotary drag bit of claim 31, wherein the plurality of first region cutters having chamfers include chamfers oriented at negative chamfer backrake angles less negative than chamfer backrake angles of the chamfers of the plurality of second and third region cutters having chamfers.

41. The rotary drag bit of claim 40, wherein at least some of the superabrasive cutting faces exhibiting chamfers exhibit at least one of differing chamfer widths and differing chamfer angles in relation to the region in which the superabrasive cutting faces exhibiting chamfers are located.

42. The rotary drag bit of claim 40, wherein the blade structures comprise a plurality of generally radially oriented blades extending generally longitudinally over the face toward the gage, and wherein the first region cutters, the second region cutters, and the third region cutters are located on the blades.

43. The rotary drag bit of claim 40, wherein effective cutting face backrake angles of the plurality of cutters are determined at least in part by cutter backrake angles of the cutters.

44. The rotary drag bit of claim 40, wherein at least one first region cutter, at least one second region cutter, and at least one third region cutter each include a chamfer having a preselected chamfer backrake angle at a cutting face periphery, and wherein the preselected chamfer backrake angles of the at least one first region cutter, the at least one second region cutter, and the at least one third region cutter are mutually different.

45. The rotary drag bit of claim 40, wherein each of the plurality of cutters include a respective longitudinal axis, and the chamfers of the first region cutters having chamfers, the second region cutters having chamfers, and the third region cutters having chamfers are disposed at substantially equal angles to their respective longitudinal axes.

46. The rotary drag bit of claim 45, wherein the chamfers of the first, second, and third region cutters having chamfers are disposed at approximately 45° with respect to their respective longitudinal axes.

47. The rotary drag bit of claim 40, wherein at least some of the cutters of the first region having chamfers exhibit chamfer widths substantially smaller than at least some of the chamfers of the cutters in the second region having chamfers.

48. The rotary drag bit of claim 47, wherein at least some of the cutters of the third region having chamfers exhibit chamfer widths intermediate in relation to chamfer widths of at least some of the cutters in the first and second regions having chamfers.

49. The rotary drag bit of claim 47, wherein at least some of the cutters of the first region having chamfers exhibit chamfer widths within a range of approximately 0.005 of an inch to approximately 0.020 of an inch.

50. The rotary drag bit of claim 49, wherein at least some of the cutters of the second region having chamfers exhibit chamfer widths within a range of approximately 0.030 of an inch to approximately 0.060 of an inch.

51. The rotary drag bit of claim 47, wherein at least some of the cutters of the second region having chamfers exhibit chamfer widths within a range of approximately 0.030 of an inch to approximately 0.060 of an inch.

52. A method of drilling a subterranean formation comprising:

providing a rotary drag bit comprising:

a bit body having a longitudinal axis and extending radially outwardly therefrom to a gage, the bit body configured to comprise at least a first region radially proximate the longitudinal axis, a second region radially proximate the gage, and a third region radially intermediate the first and second regions;

a plurality of cutters located on the bit body in the first, second, and third regions, the plurality of cutters each comprising a superabrasive cutting face having preselected geometry and exhibiting a preselected effective cutting face backrake angle with respect to a line generally perpendicular to the formation, as taken in a direction of intended bit rotation, wherein the respective cutting faces of a majority of the cutters located in the first region exhibit effective cutting face backrake angles which are substantially less aggressive than the effective cutting face backrake angles of the respective cutting faces of a majority of cutters located in the second and third regions;

orienting a face of the bit body toward a subterranean formation;

rotating the bit body at a selected rotational speed while applying a weight upon the rotary drag bit; and engaging the subterranean formation with cutters located on at least one of the first, second, and third regions of the bit body so as to penetrate the subterranean formation at a greater rate of penetration and at a lower torque-on-bit as compared to a rate-of-penetration and a torque-on-bit generated by a conventional rotary drag bit drilling the same subterranean formation at approximately the same rotational speed.

53. The method of claim 52, wherein providing a rotary drag bit further comprises configuring the bit body to comprise a plurality of blade structures, each of the blade structures extending generally longitudinally along the bit body from generally the first region through the third region and at least generally to the second region.

54. The method of claim 53, wherein configuring the bit body to comprise a plurality of blade structures further comprises configuring the blade structures to carry the plurality of cutters thereon.

55. The method of claim 54, wherein providing a rotary drag bit further comprises configuring the respective superabrasive cutting faces of the plurality of cutters to include a chamfer of a preselected width and to exhibit a chamfer angle with respect to a longitudinal axis of each of the plurality of cutters.

56. The method of claim 55, wherein providing a rotary drag bit further comprises providing a rotary drag bit comprising at least some of the plurality of cutters having superabrasive cutting faces comprising polycrystalline diamond compact tables being supported by tungsten carbide substrates.

57. The method of claim 52, wherein providing a rotary drag bit further comprises orienting a majority of the cutters located generally in the first region to have a backrake angle within a first range of cutter backrake angles, orienting a majority of the cutters generally located in the second region to have a cutter backrake angle within a second range of cutter backrake angles, and orienting a majority of the cutters generally located in the third region to have a cutter backrake angle within a third range of cutter backrake angles.

58. The method of claim 57, wherein orienting a majority of the cutters respectively located in the first, second, and third regions comprises orienting a majority of the cutters located in the first region to exhibit backrake angles ranging from about negative 10° to about negative 45°, orienting a majority of the cutters located in the second region to exhibit cutting face backrake angles not more negative than about negative 15°, and orienting a majority of the cutters located in the third region to exhibit cutting face backrake angles ranging from about negative 5° to about negative 30°.

59. The method of claim 57, wherein orienting a majority of the cutters respectively located in the first, second, and third regions comprises orienting a majority of the cutters located in the first region to exhibit cutting face backrake angles ranging from about negative 15° to about negative 30°, orienting a majority of the cutters located in the second region to exhibit cutting face backrake angles not more negative than about negative 20°, and orienting a majority of the cutters located in the third region to exhibit cutting face backrake angles ranging from about negative 10° to about negative 20°.

60. The method of claim 57, wherein orienting a majority of the cutters respectively located in the first, second, and third regions comprises orienting at least some of the majority of the cutters located in the first region to exhibit a cutting face backrake angle of approximately negative 30°, orienting at least some of the majority of the cutters located in the second region to exhibit a cutting face backrake angle of approximately negative 10°, and orienting at least some of the majority of the cutters located in the third region to exhibit a cutting face backrake angle of approximately negative 20°.

61. The method of claim 57, wherein orienting a majority of the cutters respectively located in the first, second, and third regions comprises orienting at least some of the majority of the cutters located in the first region to exhibit a cutting face backrake angle of approximately negative 20°, orienting at least some of the majority of the cutters located in the second region to exhibit a cutting face backrake angle of approximately negative 15°, and orienting at least some of the majority of the cutters located in the third region to exhibit a cutting face backrake angle of approximately negative 10°.

62. The method of claim 52, wherein providing a rotary drag bit comprising a plurality of cutters located thereon comprises selectively varying each of the preselected effective cutting face backrake angles of the cutters located on the bit body in the first, second, and third regions by selectively varying at least one of a cutter backrake angle, providing a cutting face having a preselected geometry comprising configuring the cutting face to include a chamfer of a preselected width and chamfer angle, and varying the respective cutting face angles in relation to the radial distance from the longitudinal axis in which the cutter bearing the respective cutting face is located.

63. A method of drilling a subterranean formation comprising:

providing a rotary drag bit comprising:

a bit body having a longitudinal axis and extending radially outwardly therefrom to a gage, the bit body configured to comprise at least a first region radially proximate the longitudinal axis, a second region radially proximate the gage, and a third region radially intermediate the first and second regions;

a plurality of cutters located on the bit body in the first, second, and third regions, the cutters each comprising a superabrasive cutting face having preselected geometry and exhibiting a preselected effective cutting face backrake angle with respect to a line generally perpendicular to the formation, as taken in a direction of intended bit rotation, wherein the respective cutting faces of a majority of the cutters located in the first region are on cutters oriented within a first range of relatively more aggressive cutter backrake angles, a majority of the cutting faces located in the second region are on cutters oriented within a second range of relatively less aggressive cutter backrake angles, and a majority of the cutting faces located in the third region are on cutters oriented within a third range of relatively intermediately aggressive cutter backrake angles;

configuring the respective superabrasive cutting faces of at least some of the plurality of cutters to include a chamfer of a preselected width and to exhibit a chamfer angle with respect to a longitudinal axis of each of the plurality of cutters;

orienting a face of the bit body toward a subterranean formation;

rotating the bit body at a selected rotational speed while applying a weight upon the rotary drag bit; and engaging the subterranean formation with at least one of the first, second, and third regions of the bit body so as to penetrate the subterranean formation at a greater rate of penetration and at a lower torque-on-bit as compared to a rate-of-penetration and a torque-on-bit generated by a conventional rotary drag bit drilling the same subterranean formation at approximately the same rotational speed.

64. The method of claim 63, wherein providing a rotary drag bit further comprises configuring the bit body to comprise a plurality of blade structures, each of the blade structures extending generally longitudinally along the bit body from generally the first region through the third region and at least generally to the second region.

65. The method of claim 64, wherein configuring the bit body to comprise a plurality of blade structures further comprises configuring the plurality of blade structures to carry the plurality of cutters thereon.

66. The method of claim 63, wherein providing a rotary drag bit further comprises providing a rotary drag bit comprising at least some of the plurality of cutters having the respective superabrasive cutting faces comprising polycrystalline diamond compact tables being supported by tungsten carbide substrates.

67. The method of claim 63, wherein providing a rotary drag bit further comprises orienting the majority of the cutters located generally in the first region to have a backrake angle within a first range of relatively more aggressive cutter backrake angles, orienting the majority of the cutters generally located in the second region to have a cutter backrake angle within a second range of relatively less aggressive cutter backrake angles, and orienting the majority of the cutters generally located in the third region to have a cutter backrake angle within a third range of relatively intermediately aggressive cutter backrake angles.

68. The method of claim 67, wherein orienting the majority of the cutters respectively located in the first, second, and third regions comprises orienting the majority of the cutters located in the first region to exhibit backrake angles ranging from about negative 5° to about negative 15°, orienting the majority of the cutters located in the second region to exhibit cutting face backrake angles not less negative than about negative 10°, and orienting the majority of the cutters located in the third region to exhibit cutting face backrake angles ranging from about negative 10° to about negative 20°.

69. The method of claim 67, wherein orienting the majority of the cutters respectively located in the first, second, and third regions comprises orienting the majority of the cutters located in the first region to exhibit cutting face backrake angles ranging from about negative 5° to about negative 20°, orienting the majority of the cutters located in the second region to exhibit cutting face backrake angles not less negative than about negative 15°, and orienting the majority of the cutters located in the third region to exhibit cutting face backrake angles ranging from about negative 10° to about negative 30°.

70. The method of claim 67, wherein orienting the majority of the cutters respectively located in the first, second, and third regions comprises orienting at least some of the majority of the cutters located in the first region to exhibit a cutting face backrake angle of approximately negative 7°, orienting at least some of the majority of the cutters located in the second region to exhibit a cutting face backrake angle of approximately negative 15°, and orienting at least some of the majority of the cutters located in the third region to exhibit a cutting face backrake angle of approximately negative 10°.

71. The method of claim 67, wherein orienting the majority of the cutters respectively located in the first, second, and third regions comprises orienting at least some of the majority of the cutters located in the first region to exhibit a cutting face backrake angle of approximately negative 10°, orienting at least some of the majority of the cutters located in the second region to exhibit a cutting face backrake angle of approximately negative 20°, and orienting at least some of the majority of the cutters located in the third region to exhibit a cutting face backrake angle of approximately negative 15°.

72. The method of claim 63, wherein providing a rotary drag bit comprising a plurality of cutters located thereon comprises selectively varying each of the preselected effective cutting face backrake angles of the cutters located on the bit body in the first, second, and third regions by selectively varying at least one of a cutter backrake angle, providing a cutting face having a preselected geometry comprising configuring the cutting face to include a chamfer of a preselected width and chamfer angle, and varying the respective cutting face angles in relation to the radial distance from the longitudinal axis in which the cutter bearing the respective cutting face is located.

73. A rotary drag bit for drilling a subterranean formation, comprising:

a bit body having a longitudinal axis and extending radially outward therefrom to a gage, the bit body further comprising at least a first region, a second region, and a third region, radially intermediate the first and second regions, extending over a face of the bit body to be oriented toward the subterranean formation during drilling; and a plurality of cutters located on the bit body in the first, second, and third regions, the cutters each comprising a superabrasive cutting face of a preselected geometry and including a preselected effective cutting face backrake angle with respect to a line generally perpendicular to the formation, as taken in the direction of intended bit rotation, wherein at least one cutting geometry characteristic selected from the group consisting of cutter backrake angle, effective cutting face backrake angle, chamfer angle, chamfer width, and chamfer backrake angle of at least one first region cutter, at least one second region cutter, and at least one third region cutter are mutually different;

wherein the respective superabrasive cutting face of at least some of the plurality of cutters includes a chamfer of a preselected width and a chamfer angle with respect to a longitudinal axis of each of the plurality of cutters;

wherein the bit exhibits a lower torque-on-bit for a given rate-of-penetration as compared to a torque-on-bit generated by a conventional rotary drag bit drilling the same subterranean formation at approximately the same rotational speed.

74. The rotary drag bit of claim 73, wherein the rotary drag bit exhibits directional drilling behavior substantially equal to that of the conventional rotary drag bit.

75. The rotary drag bit of claim 73, wherein at least about half of the plurality of cutters located in the first region exhibit an effective cutting face backrake angle more negative than cutters in a corresponding region of the conventional rotary drag bit, at least about half of the plurality of cutters located in the second region exhibit an effective cutting face backrake angle less negative than cutters in a corresponding region of the conventional rotary drag bit, and at least about half of the plurality of cutters located in the third region exhibit an effective cutting face backrake angle less negative than cutters in a corresponding region of the conventional rotary drag bit.

76. The rotary drag bit of claim 75, wherein the rotary drag bit exhibits directional drilling behavior substantially equal to that of the conventional rotary drag bit.

77. The rotary drag bit of claim 73, wherein at least about half of the plurality of cutters located in the first region exhibit a chamfer backrake angle more negative than the cutters in a corresponding region of the conventional rotary drag bit, at least about half of the plurality of cutters located in the second region exhibit a chamfer backrake angle less negative than the cutters in a corresponding region of the conventional rotary drag bit, and at least about half of the plurality of cutters located in the third region exhibit a chamfer backrake angle less negative than the cutters in a corresponding region of the conventional rotary drag bit.

78. The rotary drag bit of claim 77, wherein the rotary drag bit exhibits directional drilling behavior substantially equal to the conventional rotary drag bit.

79. The rotary drag bit of claim 73, wherein at least about half of the plurality of cutters located in the first, second, or third regions exhibit a smaller chamfer width than cutters in a corresponding region of the conventional rotary drag bit and at least about half of the plurality of cutters located in the first, second, or third regions exhibit a chamfer backrake angle less negative than cutters in a corresponding region of the conventional rotary drag bit.

80. The rotary drag bit of claim 79, wherein the rotary drag bit exhibits directional drilling behavior substantially equal to the conventional rotary drag bit.

81. The rotary drag bit of claim 73, wherein at least about half of the plurality of cutters located in the first region exhibit a larger chamfer width than cutters in a corresponding region of the conventional rotary drag bit, at least about half of the plurality of cutters located in the second region exhibit a smaller chamfer width than cutters in a corresponding region of the conventional rotary drag bit, and at least about half of the plurality of cutters located in the third region exhibit a smaller chamfer width than cutters in a corresponding region of the conventional rotary drag bit.

82. The rotary drag bit of claim 81, wherein the rotary drag bit exhibits directional drilling behavior substantially equal to the conventional rotary drag bit.

83. A rotary drag bit for drilling a subterranean formation, comprising:

a bit body having a longitudinal axis and extending radially outward therefrom to a gage, the bit body further comprising a face to be oriented toward the subterranean formation during drilling; and a plurality of cutters located on the bit body over the face, the cutters each comprising a superabrasive cutting face of a preselected geometry and including a preselected effective cutting face backrake angle with respect to a line generally perpendicular to the subterranean formation, as taken in the direction of intended bit rotation;

wherein the respective superabrasive cutting face of at least some of the plurality of cutters includes a chamfer of a preselected width and a chamfer angle with respect to a longitudinal axis of each of the plurality of cutters; and wherein at least one cutting geometry characteristic selected from the group consisting of cutter backrake angle, effective cutting face backrake angle, chamfer angle, chamfer width and chamfer backrake angle of at least some of the plurality of cutters are selected to enable the bit to exhibit a lower torque-on-bit for a given rate-of-penetration as compared to a torque-on-bit generated by a conventional rotary drag bit drilling the same subterranean formation at approximately the same rotational speed.

84. The rotary drag bit of claim 83, wherein the rotary drag bit exhibits directional drilling behavior substantially equal to that of the conventional rotary drag bit.

85. The rotary drag bit of claim 83, wherein at least some cutters of the plurality exhibit ever-greater aggressiveness in a progression extending substantially from cutter locations radially proximate the longitudinal axis to cutter locations radially more distant therefrom.

86. The rotary drag bit of claim 85, wherein the ever-greater aggressiveness is manifested through decreasing cutter backrake angle.

87. The rotary drag bit of claim 85, wherein the ever-greater aggressiveness is manifested through decreasing effective cutting face backrake angle.

88. The rotary drag bit of claim 85, wherein the ever-greater aggressiveness is manifested through decreasing chamfer angle.

89. The rotary drag bit of claim 85, wherein the ever-greater aggressiveness is manifested through decreasing chamfer width.

90. The rotary drag bit of claim 85, wherein the ever-greater aggressiveness is manifested through decreasing chamfer backrake angle.

91. A method of designing a rotary drag bit for drilling a subterranean formation, comprising:

selecting a configuration for a bit body having a longitudinal axis and extending radially outward therefrom to a gage, the bit body further comprising a face of the bit body to be oriented toward the subterranean formation during drilling and exhibiting a profile along which a plurality of cutters are to be placed; and selecting a plurality of cutters to be located on the bit body over the face and along the profile, the cutters of the plurality each comprising a superabrasive cutting face, the selecting further comprising selecting at least one cutting geometry characteristic for at least some of the cutters of the plurality from the group consisting of cutter backrake angle, effective cutting face backrake angle, chamfer angle, chamfer width and chamfer backrake angle to enable the bit to exhibit a lower torque-on-bit for a given rate-of-penetration as compared to a torque-on-bit generated by a conventional rotary drag bit drilling the same subterranean formation at approximately the same rotational speed.

92. The method of claim 91, further comprising selecting the at least one cutting geometery characteristic to enable the rotary drag bit to exhibit directional drilling behavior substantially equal to that of the conventional rotary drag bit.

93. The method of claim 91, further comprising selecting at least some cutters of the plurality to exhibit ever-greater aggressiveness in a progression extending substantially from cutter locations radially proximate the longitudinal axis to cutter locations radially more distant therefrom.

94. A method of altering a torque response of a rotary drag bit for drilling a subterranean formation, comprising:

selecting a configuration for a bit body having a longitudinal axis and extending radially outward therefrom to a gage, the bit body further comprising a face of the bit body to be oriented toward the subterranean formation during drilling and exhibiting a profile along which a plurality of cutters are to be placed;

selecting a plurality of cutters to be located on the bit body over the face and along the profile, the cutters of the plurality each comprising a superabrasive cutting face, wherein each cutter of the plurality exhibits at least one cutting geometry characteristic selected from the group consisting of cutter backrake angle, effective cutting face backrake angle, chamfer angle, chamfer width and chamfer backrake angle; and modifying at least one cutting geometry characteristic of at least one cutter of the plurality in relation to a torque response associated therewith.

95. The method of claim 94, wherein modifying at least one cutting geometry characteristic of at least one cutter of the plurality comprises altering at least one cutting geometry characteristic of some of the cutters of the plurality.

96. The method of claim 94, wherein modifying at least one cutting geometry characteristic of at least one cutter of the plurality comprises enabling the rotary drag bit to exhibit a lower torque-on-bit for a given rate-of-penetration as compared to a torque-on-bit generated by the rotary drag bit drilling at approximately the same rotational speed without the modification of the at least one cutting geometry characteristic of the at least one cutter of the plurality.

97. A method of altering a torque response of an existing rotary drag bit for drilling a subterranean formation, comprising:

providing an existing rotary drag bit including:

a bit body having a longitudinal axis and extending radially outward therefrom to a gage, the bit body further comprising a face of the bit body to be oriented toward the subterranean formation during drilling and exhibiting a profile along which a plurality of cutters are placed; and a plurality of cutters located on the bit body over the face and along the profile, the cutters of the plurality each comprising a superabrasive cutting face, wherein each cutter of the plurality exhibits at least one cutting geometry characteristic selected from the group consisting of cutter backrake angle, effective cutting face backrake angle, chamfer angle, chamfer width and chamfer backrake angle; and replacing at least one cutter of the plurality with another cutter exhibiting at least one different cutting geometry characteristic to alter a torque response of the replaced at least one cutter.

98. The method of claim 97, wherein replacing at least one cutter of the plurality comprises replacing at least some cutters of the plurality.

99. The method of claim 97, wherein replacing at least one cutter of the plurality with another cutter exhibiting at least one different cutting geometry characteristic comprises enabling the rotary drag bit to exhibit a lower torque-on-bit for a given rate-of-penetration as compared to a torque-on-bit generated by the rotary drag bit drilling at approximately the same rotational speed without the replacement of the at least one cutter of the plurality.

* * * * *